US007804247B2

(12) United States Patent
Morita et al.

(10) Patent No.: US 7,804,247 B2
(45) Date of Patent: Sep. 28, 2010

(54) PLASMA DISPLAY PANEL WITH PANEL MEMBER INCLUDING RECESSED PORTION

(75) Inventors: Yukihiro Morita, Osaka (JP); Naoki Kosugi, Kyoto (JP)

(73) Assignee: Panasonic Corporation, Osaka (JP)

( * ) Notice: Subject to any disclaimer, the term of this patent is extended or adjusted under 35 U.S.C. 154(b) by 669 days.

(21) Appl. No.: 11/721,967

(22) PCT Filed: Jan. 13, 2006

(86) PCT No.: PCT/JP2006/300377

§ 371 (c)(1),
(2), (4) Date: Jun. 15, 2007

(87) PCT Pub. No.: WO2006/075705

PCT Pub. Date: Jul. 20, 2006

(65) Prior Publication Data

US 2009/0251388 A1 Oct. 8, 2009

(30) Foreign Application Priority Data

Jan. 13, 2005 (JP) ..... 2005-006857

(51) Int. Cl.
*H01J 17/49* (2006.01)

(52) U.S. Cl. ..... 313/586; 313/582; 313/584; 445/24

(58) Field of Classification Search ..... 313/582–587, 313/292, 609; 445/24–25
See application file for complete search history.

(56) References Cited

U.S. PATENT DOCUMENTS

| | | | | |
|---|---|---|---|---|
| 6,450,849 | B1 | 9/2002 | Harada | |
| 6,525,470 | B1 | 2/2003 | Amemiya | |
| 6,541,922 | B2 | 4/2003 | Shirozu | |
| 6,593,693 | B1 | 7/2003 | Takagi et al. | |
| 6,650,062 | B2 | 11/2003 | Inoue et al. | |
| 2001/0006326 | A1 * | 7/2001 | Shirozu | 313/582 |

(Continued)

FOREIGN PATENT DOCUMENTS

JP 11-191376 7/1999

(Continued)

OTHER PUBLICATIONS

Jung Woo Ok et al.; "A Study on the Characteristics of AC-PDP with Stacked Facing Electrode"; Dept. of Electrical Engineering, Pusan National University, Pusan, Korea; IDW/AD '05; pp. 1443-1456.

*Primary Examiner*—Joseph L Williams
*Assistant Examiner*—Kevin Quarterman

(57) ABSTRACT

A plasma display panel has a front panel (10) and a back panel (20) that is arranged with a discharge space (30) therebetween. On the surface of the front panel facing toward the discharge space, a scan electrode (102) and a sustain electrode (103) are arranged. A dielectric layer (104) and a protective layer (105) are provided to cover the electrodes thereof and the surface. Between the scan electrode and the sustain electrode, a recessed portion (10*a*) is arranged in the first panel surface. The bottom surface (10*b*) of the recessed portion is arranged more inward in a thickness direction of the first substrate than the surfaces of the first electrode and the second electrode facing the discharge space whereby low power consumption, improved luminous efficiency, and a suppressed increase of firing voltage is achieved.

26 Claims, 18 Drawing Sheets

U.S. PATENT DOCUMENTS

| | | | | |
|---|---|---|---|---|
| 2001/0015623 | A1 * | 8/2001 | Takada et al. | 313/586 |
| 2002/0137424 | A1 | 9/2002 | Harada | |
| 2005/0218806 | A1 | 10/2005 | Sawa et al. | |

FOREIGN PATENT DOCUMENTS

| | | |
|---|---|---|
| JP | 11-297209 | 10/1999 |
| JP | 11-297215 | 10/1999 |
| JP | 2000-21304 | 1/2000 |
| JP | 2000-188063 | 7/2000 |
| JP | 2000-285811 | 10/2000 |
| JP | 2001-15038 | 1/2001 |
| JP | 2001-135238 | 5/2001 |
| JP | 2001-189132 | 7/2001 |
| JP | 2003-132804 | 5/2003 |
| JP | 2003-151449 | 5/2003 |
| JP | 2004-200036 | 7/2004 |
| JP | 2004-235042 | 8/2004 |
| JP | 2005-294051 | 10/2005 |

* cited by examiner

PLASMA DISPLAY PANEL WITH PANEL MEMBER INCLUDING RECESSED PORTION

TECHNICAL FIELD

The present invention relates to a plasma display panel and a manufacturing method thereof.

BACKGROUND ART

Plasma display panels (referred to as "PDP" hereinafter) have become prevalent due to their advantages such as the relative ease to provide large-scale screens. Among the PDPs, alternative current (AC) types have become the mainstream due to the reliability and the picture quality characteristics.

PDPs of AC types have a structure wherein a pair of panel members (referred to as panel hereinafter) is placed opposite from each other while each other sandwiching discharge space. A front panel member (referred to as front panel hereinafter) out of the pair of panel members includes a plurality of pairs of scan electrode and sustain electrode, which are display electrode pairs, on the surface of a front substrate, and includes a dielectric layer and a dielectric protective layer that cover the display electrode pairs.

A back panel member (referred to as back panel hereinafter), which is the other panel out of the pair of panels, includes (i) a plurality of address electrodes in a striped pattern that are formed on the main surface of a back substrate, (ii) the dielectric layer that covers the address electrodes, (iii) protruding barrier ribs that are arranged between the address electrodes on the surface of the dielectric layer, and (iv) phosphor layers that are formed between the barrier ribs. It should be noted that the barrier ribs may be applied, arranged in parallel crosses in the back panel to ensure the prevention of crosstalk.

The front panel and the back panel are arranged such that the dielectric protective layer and the phosphor layers face each other, and scan electrodes and sustain electrodes intersect with address electrodes three dimensionally. The front panel and the back panel are sealed at the outer periphery. The discharge space that is divided by the barrier ribs between the front panel and the back panel, is filled with discharge gases such as Xenon (Xe)-Neon (Ne) based gas, or Xenon (Xe)-Neon (Ne)-Helium (He) based gas.

To drive the PDPs that have the above-described structure, it is generally known to apply the method in which three periods, a reset period, an address period, and a sustain discharge period, are repeated sequentially. Among the three periods, it is the sustain discharge period that relates to a picture display. During this period, a pulse voltage is impressed upon the scan electrodes and the sustain electrodes in selected display cells to generate surface discharge on the dielectric protective layer.

Meanwhile, PDPs have two major tasks to accomplish, which are to achieve low cost and low power consumption. To lower the power consumption, PDPs still have need of improvement, and it is essential to improve the luminous efficiency. To accomplish the task, it is considered to be effective to adopt a structure in which a discharge gap in the display cell is set to be large so that an electrical discharge path can be lengthened. However, in the conventional types of PDPs, a discharge between the scan electrode and the sustain electrode during the sustain discharge period is the surface discharge; therefore, a large amount of voltage needs to be impressed compared to opposite discharge. As a result, increasing the discharge gap creates a problem of increasing firing voltage.

In respect of restraining the increase of the firing voltage while sustaining the large discharge gap, it is preferable to apply a structure in which opposite discharge can be generated during the sustain discharge period. To achieve the above-described requirement, a structure of providing the discharge space between the scan electrode and the sustain electrode is under study. Suggested techniques include (i) a technique wherein the scan electrode and the sustain electrode are formed to span from the top to the sides of the barrier ribs which are located in the front panel (See Patent document 1), and (ii) a technique to form the scan electrode and the sustain electrode in a way that both of the electrodes are elevated very thickly.

[Patent Document 1] Japanese Patent Application Publication No. 2003-132804; and

[Patent Document 2] Japanese Patent Application Publication No. 2003-151449.

DISCLOSURE OF THE INVENTION

The Problems the Invention is Going to Solve

However, with the conventional technologies including the technologies suggested in the two documents noted above, it is difficult to make PDPs that can achieve low cost and low power consumption. For example, when making a PDP by using the technique of Patent Document 1 noted above, it is difficult to control the shape such as the thickness of the electrodes and to secure the luminous quality during the driving, since it is necessary for the electrodes to be formed to span from the top to the sides of the barrier ribs which are located in the front panel. Also, with the technique suggested in Patent Document 2 noted above, it is not practical to thicken each electrode to such a degree that the opposite discharge is generated along the path connecting the scan electrode and the sustain electrode. To be more precise, in Patent Document 2 noted above, as a method of making such thick electrodes, the use of a plating method is described. However, when this method is actually put into practice to make electrodes, the width thereof increases as well as the thickness. Therefore, it is easy to assume that wide electrodes are made in the front panel and the electrodes block the visible light generated in the discharge space.

Means to Solve the Problems

The present invention is for solving the above-mentioned problem, and aimed to offer PDPs that can (i) improve the luminous efficiency while suppressing the increase of the firing voltage, and (ii) lower the power consumption, and to offer the manufacturing method of such PDPs.

To achieve the above-mentioned purpose, the present invention includes the characteristics described below.

The PDPs of the present invention have a structure that includes a pair of panel members that are disposed in opposition to each other with a space there between, a first panel member out of the pair of panel members having a first electrode and a second electrode that are arranged parallel to each other with a predetermined interval on a surface of a first substrate facing toward the space, and a dielectric layer covering the surface of the first substrate, wherein the first panel member includes a recessed portion that is recessed in a thickness direction of the first substrate, in an area between the first electrode and the second electrode on the surface facing toward the space, and a bottom surface of the recessed portion is kept more inward in the thickness direction of the first substrate than surfaces of the first electrode and the second electrode facing toward the space.

In addition, a manufacturing method of the PDPs of the present invention includes an electrode formation step to form a first electrode and a second electrode to align parallel to each other with a predetermined interval on one main surface of a first substrate, a dielectric layer formation step to form a dielectric layer to cover the main surface of the first substrate, and a recessed portion formation step, in which part of the dielectric layer between the first electrode and the second electrode is removed to form a recessed portion whose bottom surface is kept to be more inward in a thickness direction of the first substrate than main surfaces of the first electrode and the second electrode facing toward the space.

Effects of the Invention

The PDPs of the present invention have a structure that has recessed portions, which are each arranged between the first electrode and the second electrode on the surface facing toward a space in one of the two panels described above. Also, the dielectric layer covers the above-described structure and the bottom surfaces of the recessed portions are kept more inward in the thickness direction of the substrate than the surfaces of the first electrodes and the second electrodes facing toward the space. Accordingly, in the PDP of the present invention, each part of the recessed portions is interposed in the line connecting the first electrode and the second electrode. This means that, in the sustain discharge period during the driving of the PDP, it is possible to generate the opposite discharge which spans the recessed portion along the path connecting the first electrode and the second electrode. Therefore, the luminous efficiency can be improved without increasing the firing voltage.

As a result, the PDPs of the present invention have an advantage of having low power consumption by improving the luminous efficiency while suppressing the increase of the firing voltage.

In the PDP of the present invention, the recessed portions are each placed between the first electrode and the second electrode on the surface facing toward the space on the panel. In driving the PDP of such a form, it can be assumed that there are two types of discharge forms between the first electrode and the second electrode during the sustain discharge period. The types include (i) the opposite discharge that is described above, and (ii) the surface discharge caused by the aforementioned opposite discharge. In order that the PDPs of the present invention may be compatible with both two types of the discharge forms described above, it is preferable to define the numeric values as follows.

Considering the above-described matters, in the space between the two panels of the PDPs of the present invention, it is preferable that the space is filled with a rare gas that includes xenon whose partial pressure is 3 kpa or more, the dielectric layer has a relative permittivity in a range of 4 to 12 inclusive, and one of (i) a distance between a surface of the dielectric layer facing the space and each side surface of the first electrode and the second electrode and (ii) a distance between a surface of the dielectric layer facing the recessed portion and the each side surface of the first electrode and the second electrode is in a range of 10 μm to 40 μm inclusive. Here, the above described "distance" is defined as "one of (i) a thickness between a surface of the dielectric layer facing the space and each side surface of the first electrode and the second electrode and (ii) a thickness between a surface of the dielectric layer facing the recessed portion and the each side surface of the first electrode and the second electrode".

It should be noted here that, in the PDPs of the present invention described above, the following variation can be adopted.

In the PDPs of the present embodiment, it is preferable that each of the first electrode and the second electrode includes a plurality of element layers that are (i) arranged separately from each other in a thickness direction of the dielectric layer and (ii) electrically connected, the bottom surface of the recessed portion is kept to be more inward in the thickness direction of the first substrate than a main surface of an element layer which is arranged closest to the space among the plurality of element layers. In the PDPs that adopt the above-described structure, "thickness of the dielectric layer" is defined, based on a distance between the surface of the dielectric layer facing the space and a surface of an element layer arranged closest to a second panel member among the plurality of element layers.

As seen in the PDPs described above, adopting a structure in which the first and the second electrodes include a plurality of element layers makes it possible to reliably manufacture the panels that can be driven with the low power consumption. In other words, while forming particularly thick electrodes as seen in the above Patent Document 2 is difficult to actualize since the electrode shields the outgoing light, the PDPs of the present invention described above, on the other hand, have a multilayer structure in which the first electrodes and the second electrodes include the plurality of element layers, which makes it possible to generate a highly efficient opposite discharge without increasing the width of the electrodes.

In the PDPs of the present invention described above, it is preferable that the plurality of element layers contain a metallic material as a main component.

In the PDPs of the present invention described above, it is preferable to adopt a structure in which the dielectric layer is interposed between each of the plurality of element layers that are included in the first electrode and the second electrode.

In the PDPs of the present invention described above, it is preferable to adopt a structure in which, in each first electrode and second electrode, the plurality of element layers overlap each other when seen in the thickness direction of the first substrate.

In the PDPs of the present invention described above, it is preferable to have a structure in which (i) each of the first electrodes and the second electrodes is aligned parallel to a layer among a plurality of element layers in the surface of the substrate direction, and (ii) the plurality of respective element layers are connected electrically. Alternatively, the PDP of the present invention described above may adopt a structure in which, in each of the first electrode and the second electrode, at least one element layer out of the plurality of element layers is arranged parallel to the main surface of the first substrate.

The PDPs of the present invention described above may adopt a structure in which, only the dielectric layer is arranged between surfaces of side walls of the recessed portion and the plurality of element layers, and respective distances between the surface of the dielectric layer facing the recessed portion and each side surface of the plurality of element layers are substantially equivalent. It should be noted here that the term "substantially equivalent" herein means, for example, that it is acceptable if the variation in thickness is within ±1[%].

The PDPs of the present invention described above may adopt a structure in which the recessed portion has an opening width of at least 200 μm in a direction of a shortest line connecting the first electrode and the second electrode. With the opening width of the recessed portion set to 200 [μm] or more, if the electric potential difference is set between the first electrode and the second electrode in the sustain discharge period during the driving, an opposite discharge is generated along the path connecting the first electrode and the second electrode in the recessed portion.

Furthermore, the PDPs of the present invention described above can adopt a structure in which each of the first electrode and the second electrode is formed with a single layer that continues in a thickness direction, and a distance between the first electrode and the second electrode, with the recessed portion there between, is in a range of 60 [μm] to 160 [μm] inclusive. When such a structure is adopted, unlike the case with the structure that has a recessed portion whose opening width is 200 [μm] or more, an opposite discharge is generated first along the path connecting the first electrode and the second electrode in the recessed portion. Then the surface discharge is generated, triggered by the opposite discharge during the sustain discharge period in the driving with the electric potential difference set between the first electrode and the second electrode.

In the PDPs of the present invention described above in which the first electrodes and the second electrodes have a structure that is formed with a single layer which continues in the thickness direction, it is preferable to set the relative permittivity and the thickness, depending on the formation method of the dielectric layer.

Specifically, when the dielectric layer is formed with use of a thin film method, it is preferable that a relative dielectric permittivity thereof is in a range of 4 to 6 inclusive, and a thickness thereof is in a range of 10 μm to 20 μm inclusive. Also, in this case, it is preferable that the space is filled with a rare gas that includes xenon whose partial pressure is in a range of 9 kpa to 18 kpa inclusive.

Meanwhile, when the dielectric layer is formed with use of a thick film method, it is preferable that a relative permittivity thereof is in a range of 7 to 12 inclusive, and a thickness thereof is in a range of 20 μm to 40 μm inclusive. In this case, it is more preferable to set Xe partial pressure in the rare gas that is filled in the space in a range of 3 [kPa] to 12 [kPa] inclusive.

In the PDP of the present invention described above, when the distance between the first electrode and the second electrode is in a range of 60 [μm] to 160 [μm] inclusive, as already described above, an opposite discharge is generated, followed by a surface discharge. In this case, when each firing voltage is referred to as the voltage value Vf and the voltage value Vf', it is preferable to set each of the values in accordance with the following relationships.

In the PDP of the present invention described above, it is preferable to satisfy both relationships $Vf<Vf'$ and $(Vf'-Vf)\leqq 20[V]$. If any value is adopted that does not satisfy the above-described relationships, only the opposite discharge is generated in the recessed portions, not the surface discharge. Hence, it is problematic from the perspective of expanding a discharge area. Conversely, if the voltage value Vf and the voltage value Vf' satisfy both of the above-described relationships, the opposite discharge is generated in the recessed portions. Accordingly, electrons, ions and excited particles are generated in the discharge space. Then, the electrons, the ions, and the excited particles that are generated due to the opposite discharge become active, reducing the discharge voltage. Consequently, if the above-described relationships are satisfied, the discharge that is generated in the opposite discharge area expands in the surface direction, resulting in the discharge (surface discharge) being generated in a large area in the discharge space.

Also, in the PDPs of the present invention described above, it is preferable to set the depth of the recessed portion in a range of 10 [μm] to 30 [μm] inclusive. The reasons are described below.

PDPs have a luminous mechanism to acquire visible light by exciting phosphor layers by ultra violet rays generated by discharge. Also in PDPs, excited particles that are generated by discharge collide with a dielectric protective layer that is connected to the discharge space then become deexcited without emitting light. Consequently, ultra violet rays are not generated from the excited particles that are deexcited by colliding with the dielectric protective layer, which lowers ultra violet ray generation efficiency in PDPs.

Based on the above-described matters, the farther the dielectric protective layer is arranged from an area in which excited particles are generated, namely a discharge area, the smaller loss of excited particles by Deexcitation there is. Therefore, from the perspective of the loss of the excited particles, it is preferable to increase (i) the depth of the recessed portions and (ii) the distance from the discharge space between the panels to the dielectric protective layer in the bottom surface of recessed portions.

However, when the depth of the recessed portions is increased too much, the following disadvantage occurs. In the driving of PDPs, the visible light generated in the phosphor layer is reflected and refracted on the sides of the recessed portions, causing the decrease of the visible light. This means, the more the depth of the recessed portions is increased, the larger the side surfaces thereof becomes, resulting in the increase of an optical loss.

The present inventors, with consideration of the above stated two factors, have discovered that it is possible to reduce the total loss of the excited particles and the visible light as long as the depth of the recessed portions is in a range of 10 [μm] to 30 [μm] inclusive. The above-described range of 10 [μm] to 30 [μm] inclusive includes possible variations during the manufacturing process. In addition, when the value 20 [μm] is adopted as the depth of the recessed portions, the above-described total loss can be minimized.

Also, in the PDPs of the present invention described above, it is preferable to adopt a structure that, on a main surface of the dielectric layer in the recessed portion, a dielectric protective layer is formed by using at least one material selected from a material group that includes Mg, $MgAl_2O_4$, SrO, AlN, and $La_2O_3$.

In addition, in the PDPs of the present invention described above, it is preferable that a first section of the dielectric protective layer, which is located in wall surfaces of the recessed portion, has higher crystallinity, a more regulated crystalline orientation, or a larger secondary electron emission coefficient than a second section that excludes the first section.

In the PDPs of the present invention described above, it is preferable to have a structure in which the discharge space is filled with the discharge gas that includes Xe, the recessed portion is exposed to the space, and discharge is generated along the path connecting the first electrode and the second electrode in the recessed portion.

In the PDPs of the present invention described above, it is preferable that the first electrode and the second electrode with the recessed portion there between constitute each of a plurality of display electrode pairs, and on a second substrate included in a second panel member out of the pair of panel members, barrier ribs are respectively arranged between each adjacent display electrode pairs among the plurality of display electrode pairs so as to divide the space.

Also, in a recessed portion formation step of a manufacturing method of the PDPs of the present invention, in the area between the first electrode and the second electrode, the recessed portion is formed in such that the bottom surface thereof is kept more inward in the thickness direction of the substrate than the main surfaces of the first electrode and the second electrode facing toward the space. Therefore, as described above, it is possible to make a PDP that can generate a highly efficient opposite discharge along the path connecting the first electrode and the second electrode in the sustain discharge period during the driving.

Accordingly, in the manufacturing method of the PDPs of the present invention, it is possible to manufacture the PDPs with low power consumption by improving the luminous efficiency while suppressing the increase of the firing voltage.

During the electrode formation step in the manufacturing method of the PDPs of the present invention, it is preferable that each of the first electrodes and the second electrodes includes a plurality of element layers that are (i) arranged separately from each other in the thickness direction of the dielectric layer and (ii) electrically connected. During the dielectric layer formation step, it is preferable that the dielectric layer is formed in each space between the plurality of element layers that constitute each of the first electrodes and the second electrodes. The reasons to support the statement have already been provided above.

During the recessed portion formation step in the manufacturing method of the PDPs of the present invention described above, it is preferable that a sandblasting method is used to remove part of the dielectric layer.

During the recessed portion formation step in the manufacturing method of the PDPs of the present invention described above, it is preferable that part of areas of the first electrode and the second electrode in a width direction is also removed.

In the manufacturing method of the PDPs of the present invention described above, it is preferable to have a second dielectric layer formation step in which the dielectric layer is formed on side wall surfaces of the recessed portion, covering edges of the element layers that are exposed during the recessed portion formation step.

In the second dielectric layer formation step of the manufacturing method of the PDPs of the present invention described above, it is preferable that a dielectric material in a form of a sheet is used to form the dielectric layer.

In the dielectric layer formation step of the manufacturing method of the PDPs of the present invention described above, it is preferable that a photosensitive dielectric sheet is used to form the dielectric layer, and in the recessed portion formation step, an exposure etching method is used to form the recessed portion.

In the manufacturing method of the PDPs of the present invention described above, it is preferable to have a protective layer formation step in which the dielectric protective layer is formed on a surface of the dielectric layer in an area of the recessed portion, by using at least one material selected from a material group that includes Mg, $MgAl_2O_4$, SrO, AlN, and $La_2O_3$.

DESCRIPTION OF CHARACTERS

Figure 1:
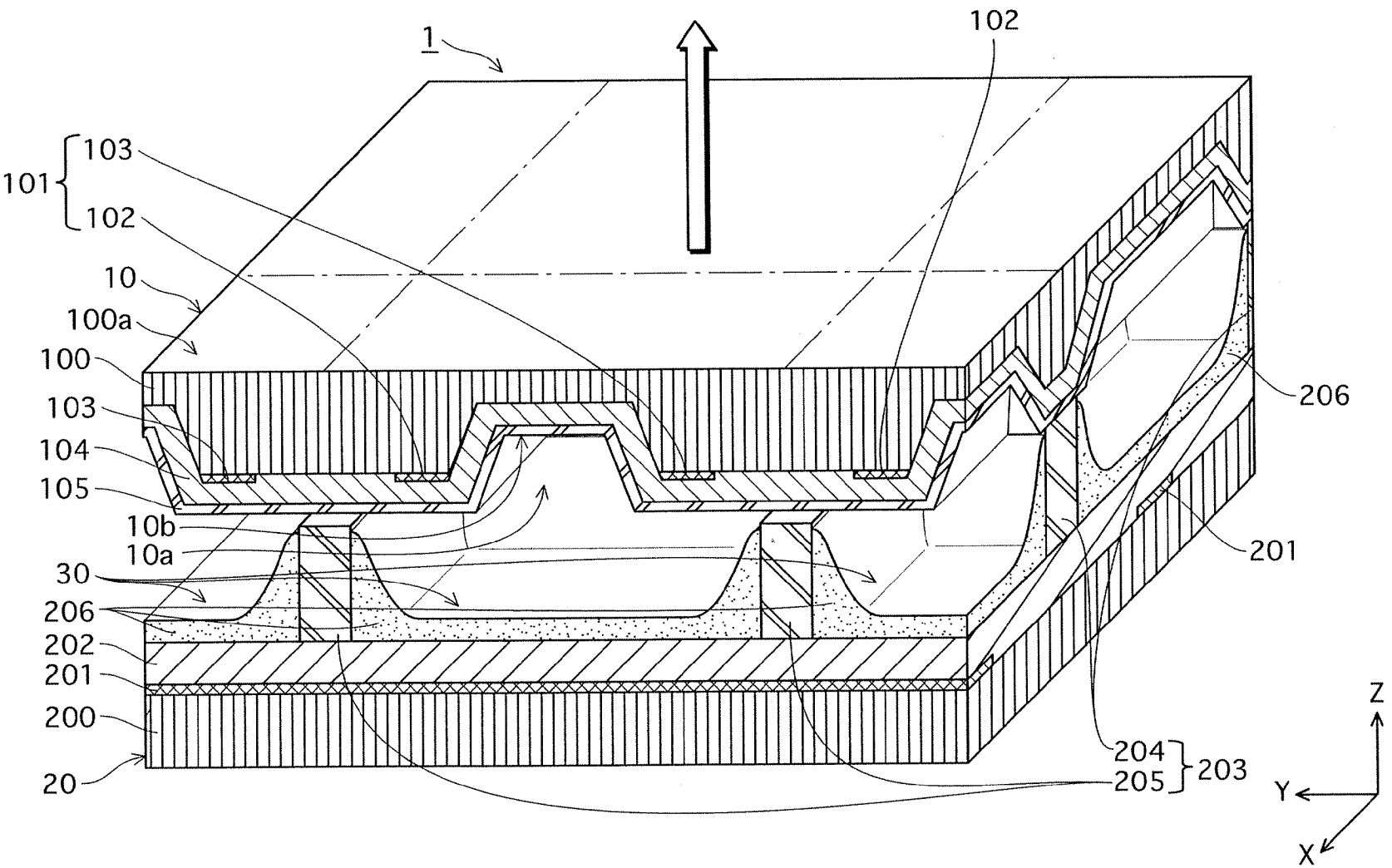
FIG. 1 shows the perspective view of the main part (local sectional view) of the PDP 1 of the first embodiment.

1,2,3,4,5 PDP
10,40,50,60,70 front panel
20 back panel
100,400,500,600,700 front substrate
101,401,501,601,701 display electrode pair
102,402,502,602,702 scan electrode
103,403,503,603,703 sustain electrode
104,404,504,604,704 dielectric layer
105,405,505,605,705 dielectric protective layer
200 back substrate
201 address electrode
202 dielectric layer
203 barrier rib
204 the barrier rib first element
205 the barrier rib second element
206 phosphor layer
402*a*,502*a*,602*a*,702*a* the scan electrode first element layer
402*b*,502*b*,602*b*,702*b* the scan electrode second element layer
403*a*,503*a*,603*a*,703*a* the sustain electrode first element layer
403*b*,503*b*,603*b*,703*b* the sustain electrode second element layer
404*a*,504*a*,604*a*,704*a* the dielectric layer first element layer

404*b*,504*b*,604,704*b* the dielectric layer second element layer

602*c*,702*c* the scan electrode third element layer

603*c*,703*c* the sustain electrode third element layer

BEST MODE FOR CARRYING OUT THE INVENTION

The following provides the descriptions of the best mode for carrying out the present invention with several examples. It should be noted that the embodiments used for the descriptions below are merely examples for the clear and detailed explanations of the characteristics of the structure and the acts of the present invention. Therefore the present invention shall not be limited to the embodiments that are described below.

First Embodiment 1-1. Structure of Plasma Display Panel 1

The following provides descriptions of a structure of the plasma display panel 1 (described as PDP hereinafter) of the first embodiment with reference to FIG. 1, which shows the perspective view of the main part (local sectional view) of the PDP 1.

As shown in FIG. 1, PDP 1 has a structure in which the front panel 10 and the back panel 20 are placed opposite from each other with the discharge space 30 there between. In the front panel 10 that is provided on the main surface of the front substrate 100 (main surface that faces downward in Z axial direction in FIG. 1), the display electrode pairs 101, which extend in axial direction, are arranged. Each of the display electrode pairs 101 includes aligned scan electrode 102 and sustain electrode 103.

The surface of the front substrate 100 on which the scan electrodes 102 and the sustain electrodes 103 are formed, is covered with the dielectric layer 104, and the dielectric protective layer 105 laminates the surface thereof.

As shown in FIG. 1, the PDP 1 of the present embodiment has the structure in which, in each discharge cell, the dielectric layer 104 and the dielectric protective layer 105 are recessed (upward in Z axial direction) in the direction of thickness of the front substrate 100 to form the recessed portions 10*a*, in the areas sandwiched between the scan electrodes 102 and the sustain electrodes 103 in the front panel 10. Specifically, the corresponding sections on the front substrate 100 are recessed upward in Z axial direction, and then the dielectric layer 104 and the dielectric protective layer 105 are formed along the recessed sections, so that the recessed portions 10*a* are formed.

Among the components of the above-mentioned front panel 10, the scan electrode 102 and the sustain electrode 103 are made from a metallic material such as Ag or Cr—Cu—Cr.

On the back panel 20, a plurality of address electrodes 201 are formed, extending in Y axial direction, on the main surface of the back substrate 200 which faces upward in Z axial direction, and the dielectric layer 202 covers the address electrodes 201. Then, the barrier ribs 203 are arranged on the surface of the dielectric layer 202, and the phosphor layers 206 are formed in each of the recessed portions that is formed with the sides of the barrier rib 203 and the surface of the dielectric layer 202. As shown in FIG. 1, the barrier ribs 203 are formed in parallel crosses, with the combination of (i) the barrier rib first element 204 (described as "main barrier rib" hereinafter) which is formed along the direction (Y axial direction) of extension of the address electrode 201, and (ii) the barrier rib second element 205 (described as "sub barrier rib" hereinafter) which is formed along the direction (X axial direction) of extension of the display electrode pair 101.

In the PDP 1, each of the areas, which is surrounded by the main barrier ribs 204 and the sub barrier ribs 205, is equivalent to the discharge cell that is the minimum unit of luminescence. It should be noted that, as to the barrier ribs 203, the height of the main barrier ribs 204 is slightly higher than the sub barrier ribs 205 in Z axial direction, so that when the main barrier ribs 204 are placed opposite to the front panel 10, a small space is created between the top part of the sub barrier ribs 205 and the dielectric protective layer 105.

In the PDP 1, the front panel 10 and the back panel 20 are put together, and the outer periphery thereof is sealed by using fritted glass to create the discharge space 30 inbetween. The discharge space 30 is filled with discharge gas that includes a gas mixture such as a Xenon(Xe)-Neon(Ne) based or a Xe—Ne-Helium(He) based gas. The filling pressure of the discharge gas is set to be substantially 60 [kPa]. When the PDP1 is driven, ultra violet rays generated in the discharge space 30 are converted into visible light by the phosphor layer 206 of the back panel 20 in the unit of a discharge cell, which is formed at each of the three-dimensional intersections of the pair of the scan electrode 102 and the sustain electrode 103 and the address electrode 201, and emitted from the outer main surface 10*a* of the front panel 10.

It should be noted that the discharge gas that is filled in the discharge space 30 is a gas mixture with high xenon density whose partial pressure of xenon component is 3 [kPa] or more.

1-2. Detailed Structure of Front Panel 10

Figure 2:
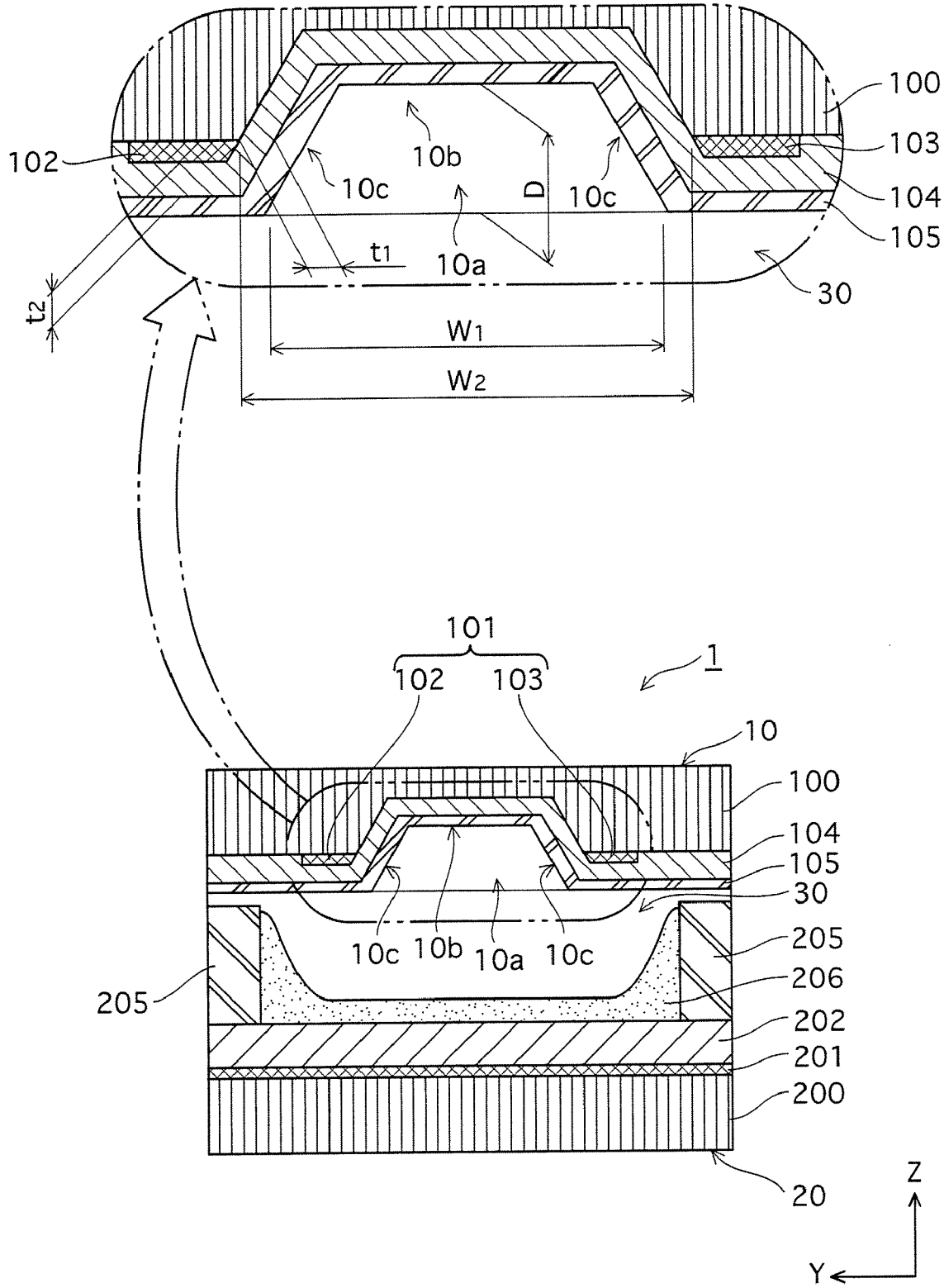
FIG. 2 shows the schematic sectional view of the detailed structure of the PDP 1.

The following provides the descriptions of the front panel 10 which is the most characteristic component in the structure of the PDP 1 of the present embodiment, with reference to the FIG. 2.

As shown in FIG. 2, in the PDP 1 of the present embodiment, as stated above, the recessed portion 10*a* is formed between the scan electrode 102 and the sustain electrode 103 in the front panel 10 in each of the discharge cells. In the recessed portion 10*a* in the front panel 10 in each of the discharge cells, its bottom surface 10*b* is kept more inward in the thickness direction of the front substrate 100 than the main surfaces 102*f* and 103*f* of the scan electrodes 102 and the sustain electrodes 103 on the side of each discharge space 30.

In addition, for the part in which the recessed portion 10*a* is formed, a laminated constitution is adopted, which includes the dielectric layer 104 and the dielectric protective layer 106. The side surfaces 10*c* of the recessed portion 10*a* are formed to have angles with respect to both of the thickness direction of the front substrate 100 (Z axial direction) and the main surface direction (Y axial direction).

What is described below are measurements of the recessed portion 10*a* and therearound, with reference to the enlarged part of FIG. 2.

As shown in the enlarged part of FIG. 2, the depth from the opening of the recessed portion 10*a* to the bottom surface 10*b*, in other words, the depth D of the recessed portion 10*a*, as described above, is set in such a way that the bottom surface 10*b* is kept to be more upward in Z axial direction in the enlarged part of FIG. 2 than the main surfaces 102*f* and 103*f* of the scan electrode 102 and the sustain electrode 103 on the sides of the discharge space 30. The appropriate optimum value of the depth D of the recessed portion 10*a* is also selected depending on a panel size and such. For example, the appropriate optimum value thereof can be set between 10 [μm] and 30 [μm]. The reason for this is described below.

As shown in the enlarged part of FIG. 2, the dielectric layer 104 in the side surface 10*c* of the recessed portion 10*a* is formed to have the thickness $t_1$ in the direction of the shortest line connecting the edges of the scan electrode 102 and the sustain electrode 103.

The dielectric layer 104 excluding the area of the recessed portion 10*a* is formed to have the thickness $t_2$ in Z axial direction, based on the main surfaces 102*f* and 103*f* of the scan electrode 102 and the sustain electrode 103 that are on the sides of the discharge space 30. Here, in the PDP 1 of the present embodiment, (i) the thickness $t_1$ of the dielectric layer 104 which is located on the side surfaces 10*c* of the recessed portion 10*a* and (ii) the thickness $t_2$ that excludes the area of the recessed portion 10*a* are set to be substantially equivalent. For example, the thickness $t_1$ and the thickness $t_2$ are set in a range of 10 [μm] to 40 [μm] inclusive. The reason for this is also described below.

It should be noted that the above-mentioned "substantially equivalent" means, for example, that it is acceptable to have different values between the thickness $t_1$ and the thickness $t_2$ as long as the difference is within 1[%].

The recessed portion 10*a* is formed to have an opening width $W_1$; and the opening width $W_1$ is set, for example, between 40 [μm] and 140 [μm]. It should be noted that, in FIG. 2, since the recessed portion 10*a* is drawn schematically, the dielectric protective layer 105 has angles at the both ends of the opening width. However, if the open ends are rounded, the opening width $W_1$ can be set by calculating the imaginary intersecting point of (i) the surface of the dielectric protective layer 105 that excludes the area of the recessed portion 10*a*, and (ii) the surface of the dielectric protective layer 105 on the side surface 10*c* of the recessed portion 10*a*.

In the PDP 1, the width in Y axial direction between the scan electrode 102 and the sustain electrode 103 which are both in the discharge cell is set to the width $W_2$. As a specific value of the width $W_2$, it is applicable to set in a range of 60 [μm] to 160 [μm] inclusive.

Also, in the PDP 1, the dielectric layer 104 of the front panel 10 includes a material whose relative permittivity $\in$ is in a range of 4 to 12 inclusive.

In addition, in the PDP 1, the dielectric protective layer 105 has a structure described below.

In the dielectric protective layer 105 of the PDP 1 of the present embodiment, areas corresponding to the side surfaces 10*c* of the recessed portion 10*a* has (i) higher crystallinity, (ii) a more regulated crystalline orientation, and (iii) a larger secondary electron emission coefficient ν than an area that excludes the side surfaces 10*c* of the recessed portion 10*a*. Such characteristic differences in each part of the dielectric protective layer 105 can be obtained by a manufacturing method of the PDP 1 of the present embodiment that is described below.

1-3. Manufacturing Method of PDP 1

The following is a manufacturing method of the PDP 1 that has the above-described structure with reference to FIGS. 3A to 3C and FIG. 4A to FIG. 4B.

Figure 3A:
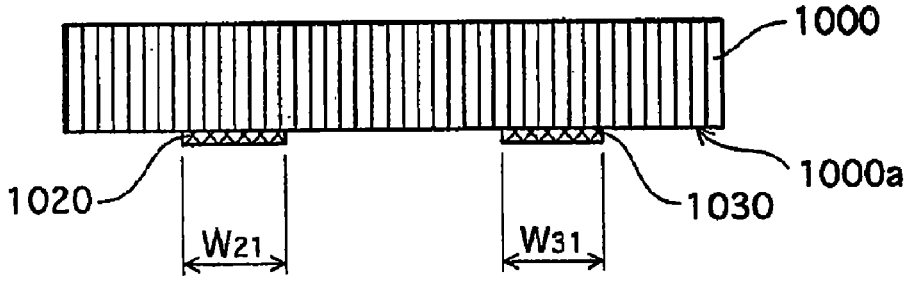
FIGS. 3A to 3C show the schematic process chart of the manufacturing process of the PDP 1.

As shown in FIG. 3A, on one main surface 1000*a* of a glass substrate 1000, the striped electrode films 1020 and electrode films 1030 are arranged parallel to each other with a space inbetween. To form each of the electrode films 1020, 1030, for example, it is possible to use a metallic material such as Cr—Cu—Cr, or Ag. In other words, instead of a transparent electrode such as ITO (Indium Tin Oxide), $SnO_2$ or ZnO, only a metallic material is used (it is practically acceptable to contain other substances that are on the level of impurity). In addition, widths $W_{21}$ and $W_{31}$ of the electrode films 1020, 1030 are wider than each width of the scan electrode 102 and the sustain electrode 103.

It should be noted that, to form the electrode films 1020, 1030, it is preferable to use (i) a sputtering method when the material used is Cr—Cu—Cr, (ii) a printing method when the material used is Ag.

Figure 3B:
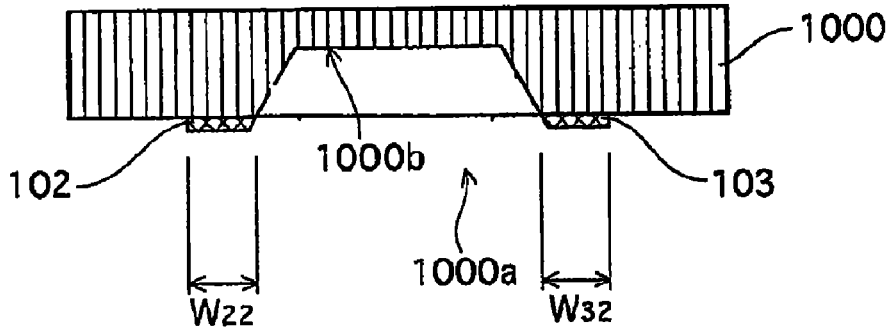

Then, as shown in FIG. 3B, an area between the electrode film 1020 and the electrode film 1030 on the glass substrate 1000 is patterned to form a recessed portion 1000*a*. To form the recessed portion 1000*a*, it is possible to use a sandblasting method and such. The recessed portion 1000*a* is formed so that the bottom surface 1000*b* has the relationship shown in the enlarged part in FIG. 2 by taking into consideration the lamination of the dielectric layer 104 and the dielectric protective layer 105 that are formed in the process described below. In addition, during this patterning, parts of the areas of the electrode films 1020 and 1030 in the width direction are also removed to form the scan electrode 102 and the sustain electrode 103. Here, each of the scan electrode 102 and the sustain electrode 103, as shown in FIG. 3B, is a single layer that continues in the thickness direction.

As shown in FIG. 3B, since parts of the electrode films 1020 and 1030 are further scraped off by the patterning, the scan electrode 102 and the sustain electrode 103 have narrower widths $W_{22}$, $W_{32}$ than widths $W_{21}$, $W_{31}$ of the electrode films 1020 and 1030, which are formed in the process shown in FIG. 3A. Conversely, widths $W_{21}$, $W_{31}$ of the electrode films 1020 and 1030 are set, by taking into consideration the width of the parts to be removed by the patterning, so as to be large enough to obtain the widths $W_{22}$, $W_{32}$ of the scan electrode 102 and the sustain electrode 103 of the PDP 1.

It should be noted here that, when the recessed portion 1000*a* is formed by the patterning described above, the sides thereof are inclined against the thickness direction of the glass substrate 1000 to have angles.

Figure 3C:
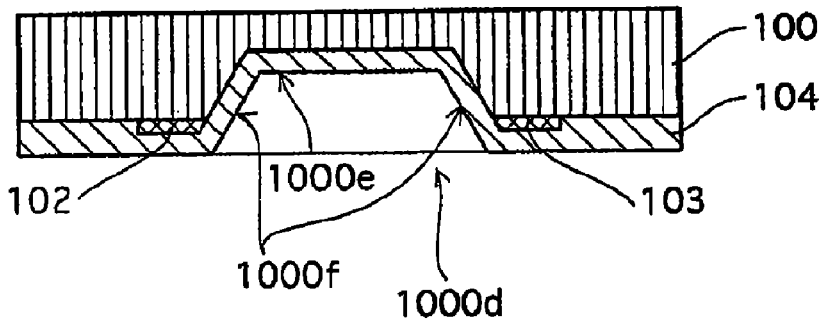

As shown in FIG. 3C, the dielectric layer 104 is formed along the patterned surface. To form the dielectric layer 104, it is possible to adopt a paste coating method. However, to equalize the film thickness of the dielectric layer 104, it is preferable to adopt a method that uses a dielectric material which is formed into a sheet. In other words, by adopting a method that uses a dielectric material in a form of a sheet, the thicknesses of the side surfaces 1000*f* of the recessed portions 1000*d* described in FIG. 3C are equalized over the whole panel. Also, in the present embodiment, the distance between (i) the surfaces of the recessed portions 10*a* and (ii) each of the scan electrodes 102 and sustain electrodes 103 is equalized across the whole panel. With this construction, it is possible to decrease the variation of the discharge characteristics between the discharge cells as well as to improve the picture quality.

Additionally, in the PDP 1, by adopting the manufacturing process of the dielectric layer 104 described above, it is possible to substantially equalize (i) the thickness $t_1$ of the dielectric layer 104 at the side surfaces 10*c* of the recessed portion 10*a*, and (ii) the thickness $t_2$ of the dielectric layer 104 at the part that excludes the recessed portion 10*a*, without going through a complicated adjustment process.

It should be noted that even after the dielectric layer 104 whose thickness is in a range of 10 [μm] to 40 [μm] inclusive as described above, is formed, the bottom surface 1000*e* of the recessed portion 1000*d* is kept more inward in the thickness direction of the front substrate 100 than the main surfaces 102*f* and 103*f* of the scan electrode 102 and the sustain electrode 103 on the sides of discharge space 30. Additionally, when the dielectric layer 104 is formed with a dielectric material in a form of a sheet, it is preferable to set the thickness of the dielectric layer 104 in consideration of the change of the thickness thereof by heating.

Figure 4A:
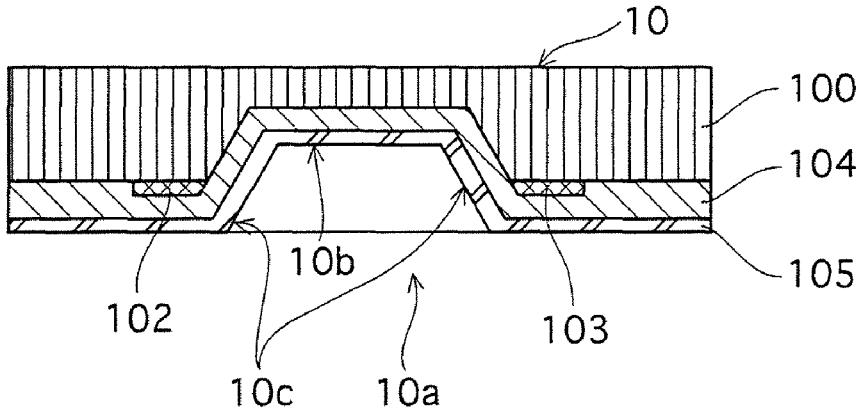
FIGS. 4A to 4B show the schematic process chart of the manufacturing process of the PDP 1.

Next, the dielectric protective layer 105 is formed along the surface of the dielectric layer 104 that includes the bottom surface 1000*e* and the side surfaces 1000*f* of the recessed portion 1000*d*, as shown in FIG. 4A. The dielectric protective layer 105 is formed, for example, with at least one material out of the material group that includes Mg, $MgAl_2O_4$, SrO, AlN and $La_2O_3$, by using an electron beam evaporation method, an ion gun deposition method or other methods.

As shown in FIG. 4A, in the front panel 10 of the PDP 1 of the present embodiment, the side surfaces 10*c* of the recessed portion 10*a* have inclined flat surfaces; therefore, the dielectric protective layer 105 at the side surfaces 10*c* has the high crystallinity and the regulated crystalline orientation. Accordingly, portions of the dielectric protective layer 105 at the side surfaces 10*c* are more superior in the secondary electron emission characteristic (are larger in the secondary electron emission coefficient ν) than the other portions thereof. This means that, when the dielectric protective layer 105 is formed with the manufacturing method of the present embodiment that includes the above-mentioned electron beam evaporation method or ion gun deposition method, the above-mentioned materials are deposited obliquely in the side surfaces 10*c* of the recessed portions 10*a*. Accordingly, the obliquely deposited part of the dielectric protective layer 105 has higher crystallinity and a more regulated orientation than the part that is not deposited obliquely, and the secondary electron emission coefficient ν of the dielectric protective layer 105 at the side surfaces 10*c* is larger than the other parts of dielectric protective layer 105.

Figure 4B:
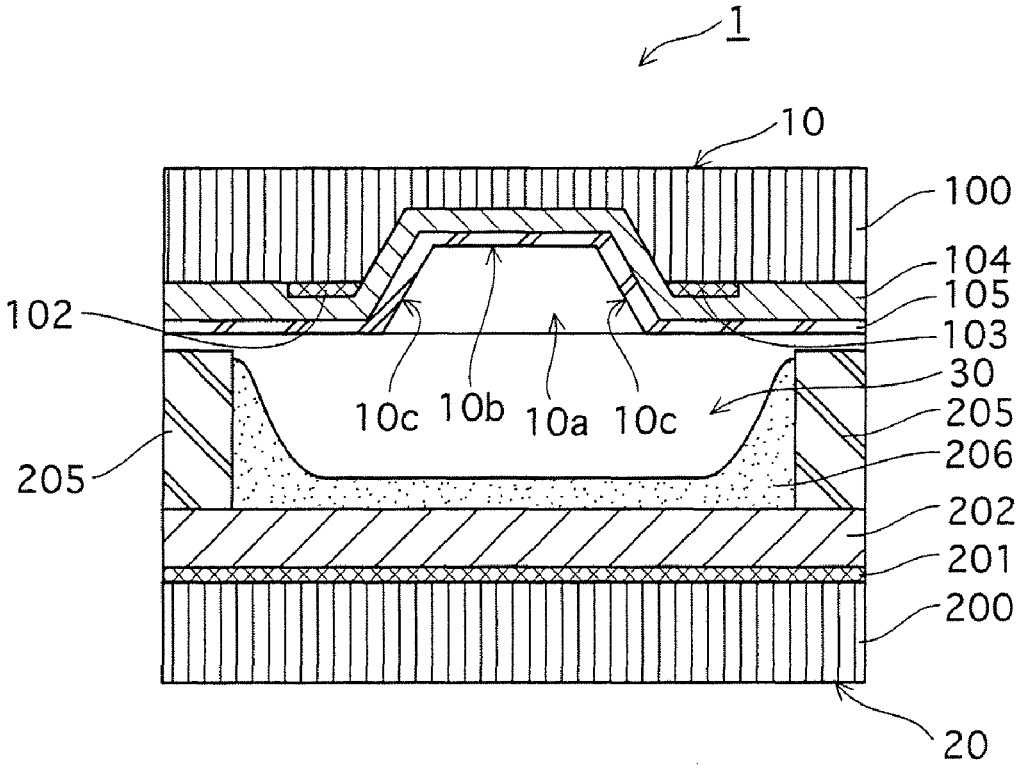

Next, as shown in FIG. 4B, the front panel 10 that is formed as described above, is put together with the back panel 20 such that the dielectric protective layer 105 faces the back panel 20, then sealed at the outer periphery. Here, the front panel 10 and the back panel 20 are arranged in such a direction where each display electrode pair 101 that includes the scan electrode 102 and the sustain electrode 103 intersects with the address electrodes 201 that are formed on the back panel 20.

The back panel 20 that is put together with the front panel 10, is provided with the above-mentioned address electrodes 201, dielectric layer 202, barrier ribs 203 (only the sub barrier ribs 205 are shown in FIG. 3C for convenience of drawing), and the phosphor layers 206, on the main surface of the back substrate 200 in advance.

Here, the address electrodes 201 of the back panel 20 are formed, for example, with Cr—Cu—Cr or Ag; and the dielectric layer 202 is formed with low melting glass. Additionally, to form the phosphor layer 206, the following phosphor materials may be used.

R; $(Y,Gd)BO_3$:Eu

G; $Zn_2SiO_4$:Mn

B; $BaMg_2Al_{14}O_{24}$:Eu

It should be noted here that the figures related to the following descriptions are omitted. A continuous hole is formed to move gas in and out to/from the discharge space 30 that has been formed by sealing. The gas remaining in the discharge space 30 is then exhausted through the continuous hole. Subsequently, discharge gas such as Xe—Ne based gas mixture is filled until the internal pressure in the discharge space 30 becomes substantially 60 [kPa]. To exhaust the residual gas and filling the discharge gas, the heights of sub barrier ribs 205 are formed to be slightly lower than the main barrier ribs 204 so as to secure the good gas circulation. Finally, the continuous hole is sealed to complete the PDP 1.

It should be noted that, when manufacturing the PDP 1 of the present embodiment, the component ratio of Xe in the discharge gas is preliminarily adjusted in a way that the partial pressure thereof becomes 3 [kPa].

Also, in the present embodiment, as described above, the dielectric layer 104 is formed by using a thick film method. However, a thin film method is also adoptable to form the dielectric layer 104. Also, it is preferable to change the settings of each value, depending on the formation method of the dielectric layer 104. Specific values are described as follows.

1-3-1. Using Thin Film Method to Form Dielectric Layer 104

When a thin film method is used to form the dielectric layer 104, the relative permittivity ∈ is set in a range of 4 to 6 inclusive. Also, in this case, it is preferable to set (i) the thicknesses $t_1$ and $t_2$ of the dielectric layer 104 in a range of 10 [μm] to 20 [μm] inclusive, and (ii) the Xe partial pressure in the discharge gas in a range of 9 [kPa] to 18 [kPa] inclusive. The reasons for the above statements are described below.

First, in the case where the dielectric layer 104 is formed by using the thin film method in a manner that causes the thickness $t_1$ or $t_2$ being too large, cracks are apt to be made, the maintenance cycle in the process becomes short, and the tact time becomes long.

Conversely, in the case where the dielectric layer 104 is formed by using the thin film method in a manner that causes the thickness $t_1$ or $t_2$ being too thin, dielectric breakdown is apt to occur. Therefore, when the thin film method is used to form the dielectric layer 104 in the present embodiment, the thickness $t_1$ or $t_2$ is set to be in a range of 10 [μm] to 20 [μm] inclusive.

Figure 5:
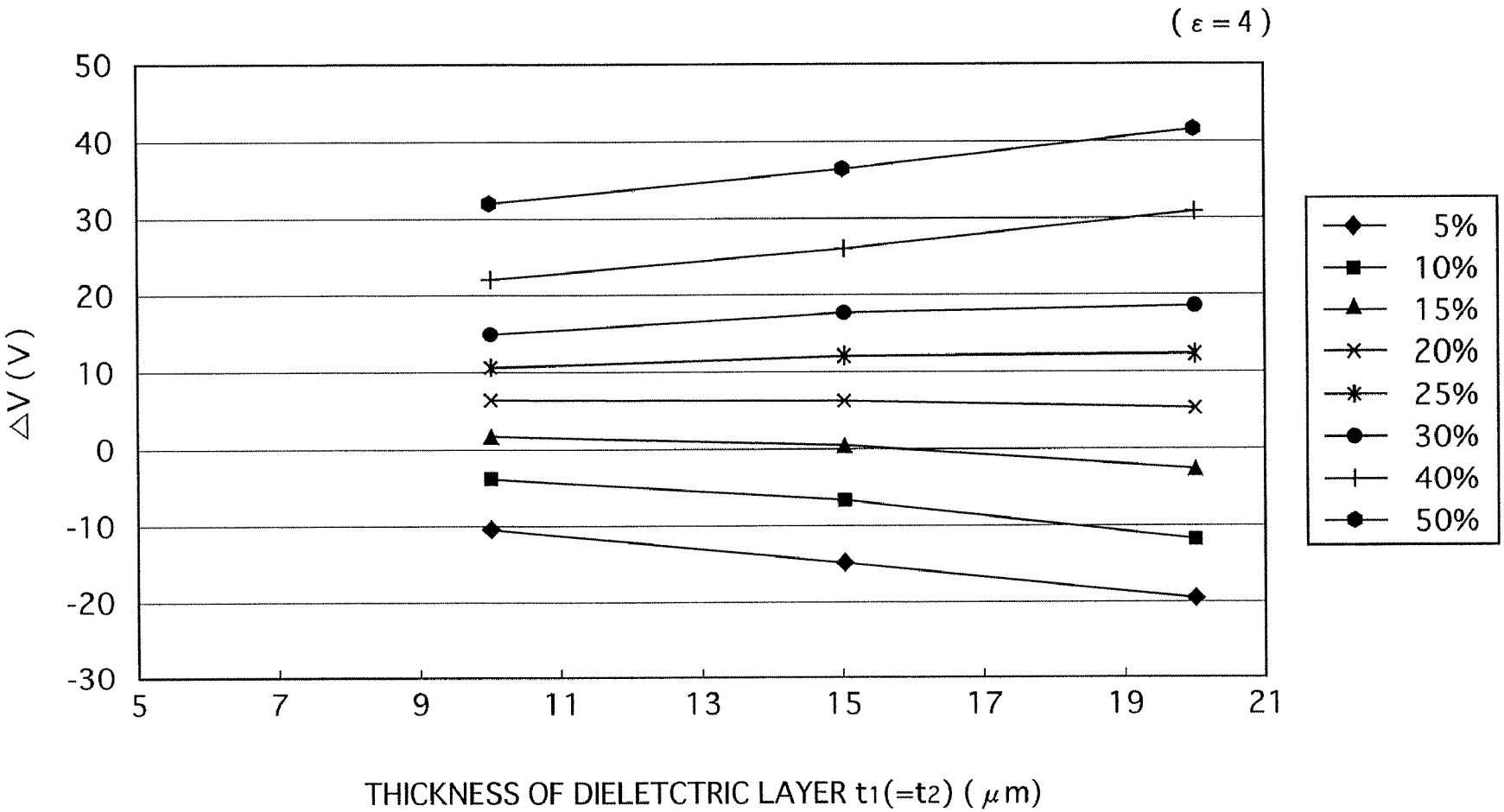
FIG. 5 shows the characteristic chart of the relationship between the discharge voltage and the thickness of the dielectric layer 104 when the relative permittivity ∈ of the dielectric layer 104 is 4.

The following is the description of the above-described setting range of Xe partial pressure with reference to FIG. 5, which is a characteristic chart showing the dependence of discharge voltage on the thickness of the dielectric layer 104, when the relative permittivity ∈ of the dielectric layer is 4, and each of the thicknesses t1, t2 thereof is in a range of 10 [μm] to 20 [μm] inclusive. It should be noted that ΔV of the vertical axis in FIG. 5 means (Vf'−Vf). Also, in FIG. 5, each of the values in the legend shows the ratio of Xe partial pressure to the total pressure (60 [kPa]) of the discharge gas (a gas mixture of Xe/Ne). The values above also apply to FIG. 6 and FIG. 7, which are referred to in the following descriptions.

As shown in FIG. 5, when the relative permittivity ∈ of the dielectric layer 104 is set to 4, it is preferable to set Xe partial pressure to satisfy the conditions: (i) the firing voltage Vf in the opposite discharge is smaller than the firing voltage Vf' in the surface discharge, and (ii) the voltage difference is 20[V] or smaller. To be more precise, in FIG. 5, it is preferable to select ΔV within a range above 0[V] to 20[V]. Accordingly, when the thin film method is used to form the dielectric layer 104, it is preferable to set Xe partial pressure to be in a range of 9 [kPa] to 18 [kPa] inclusive.

In addition, as described above, in the present embodiment, when the thin film method is used to form the dielectric layer 104, the thicknesses $t_1$ and $t_2$ of the dielectric layer 104 are restricted by the reactive power and the dielectric withstanding voltage, and are set to be in a range of 10 [μm] to 20 [μm]. However, if it is possible to secure withstanding pressure that is able to prevent a dielectric breakdown from being caused by the driving voltage, the thicknesses $t_1$ and $t_2$ of the dielectric layer 104 may set to be in a range of 5 [μm] to 20 [μm] inclusive.

1-3-2. Using Thick Film Method to Form Dielectric Layer 104

When a thick film method is used to form the dielectric layer 104, the relative permittivity ∈ is set in a range of 7 to 12 inclusive. Also, in this case, it is preferable to set the thicknesses $t_1$ and $t_2$ of the dielectric layer 104 in a range of 20 [μm] to 40 [μm] inclusive, and to set the Xe partial pressure in the discharge gas in a range of 3 [kPa] to 12 [kPa] inclusive. The reasons for the above statements are described below.

First, in the case that the thick film method is used to form the dielectric layer 104, when the relative permittivity ∈ of the dielectric layer 104 is set to be too large, the capacity increases as well as the reactive power. Therefore, when the thick film method is used to form the dielectric layer 104, it is practical to set the maximum value of the relative permittivity ∈ of the dielectric layer to 12, which is the equivalent maximum value of the dielectric permittivity ∈ of the dielectric layer of conventional PDPs. Additionally, when the thick film method is used to form the dielectric layer 104, it is considered to be necessary to set the thicknesses $t_1$, $t_2$ of the dielectric layer 104 to 20 [μm] or above, to avoid the dielectric breakdown during the driving of the PDP. Generally, the dielectric layer that is formed with use of the thick film method has lower withstanding pressure than the dielectric layer that is formed with use of the thin film method; therefore, it is necessary to make the dielectric layer thicker with the thick film method than with the thin film method.

Additionally, since the capacity becomes smaller and the discharge voltage becomes larger if the thicknesses $t_1$, $t_2$ of the dielectric layer 104 are set to be too thick, it is practical to set the upper limit of the thickness thereof to 40 [μm], which is the same value as that of the conventional PDPs. Accordingly, when the thick film method is used to form the dielectric layer 104, it is preferable to set the thicknesses $t_1$, $t_2$ in a range of 20 [μm] to 40 [μm] inclusive.

Figure 6:
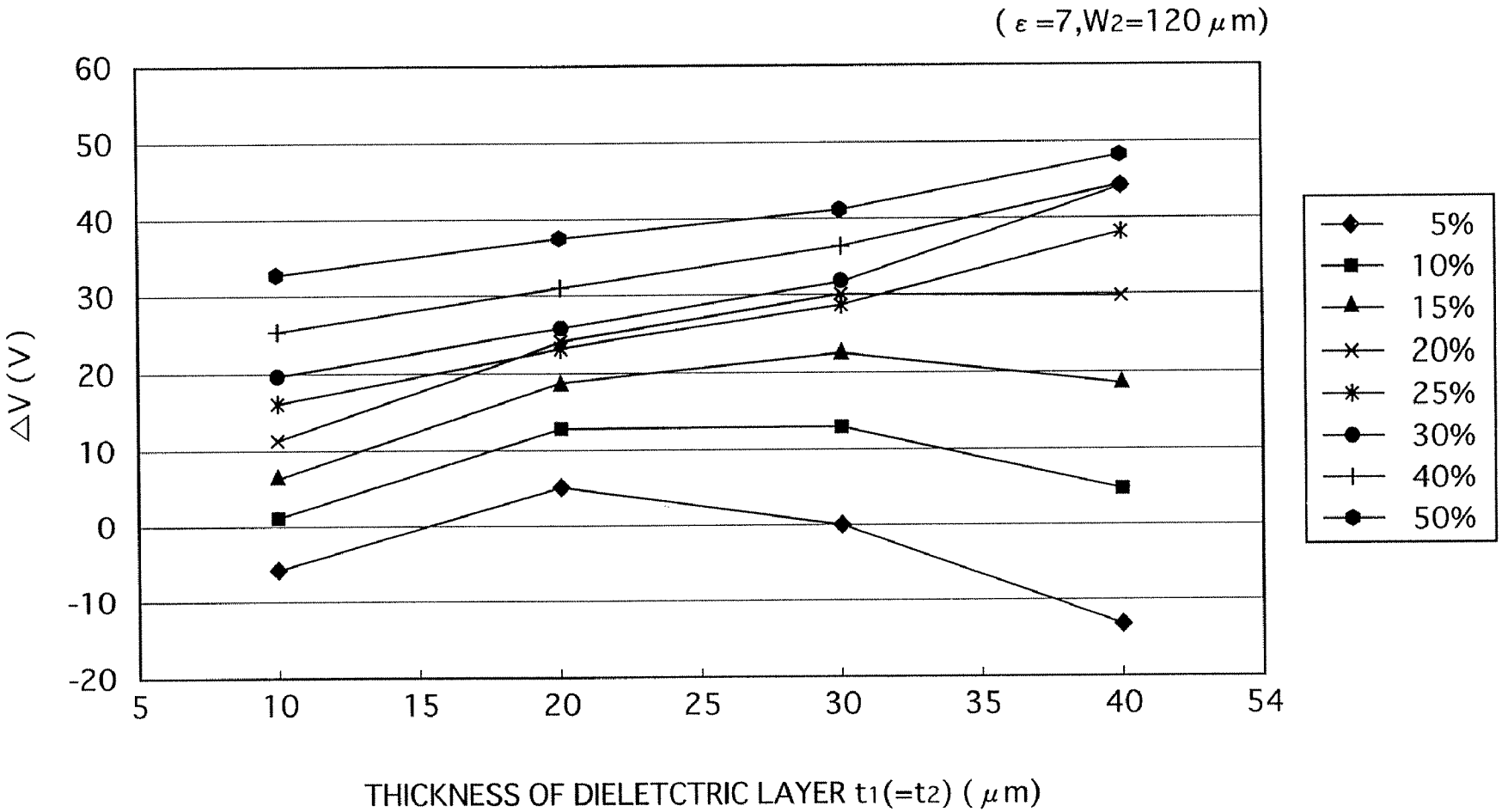
FIG. 6 shows the characteristic chart of the relationship between the discharge voltage and the thickness of the dielectric layer 104 when the relative permittivity ∈ of the dielectric layer 104 is 7.
Figure 7:
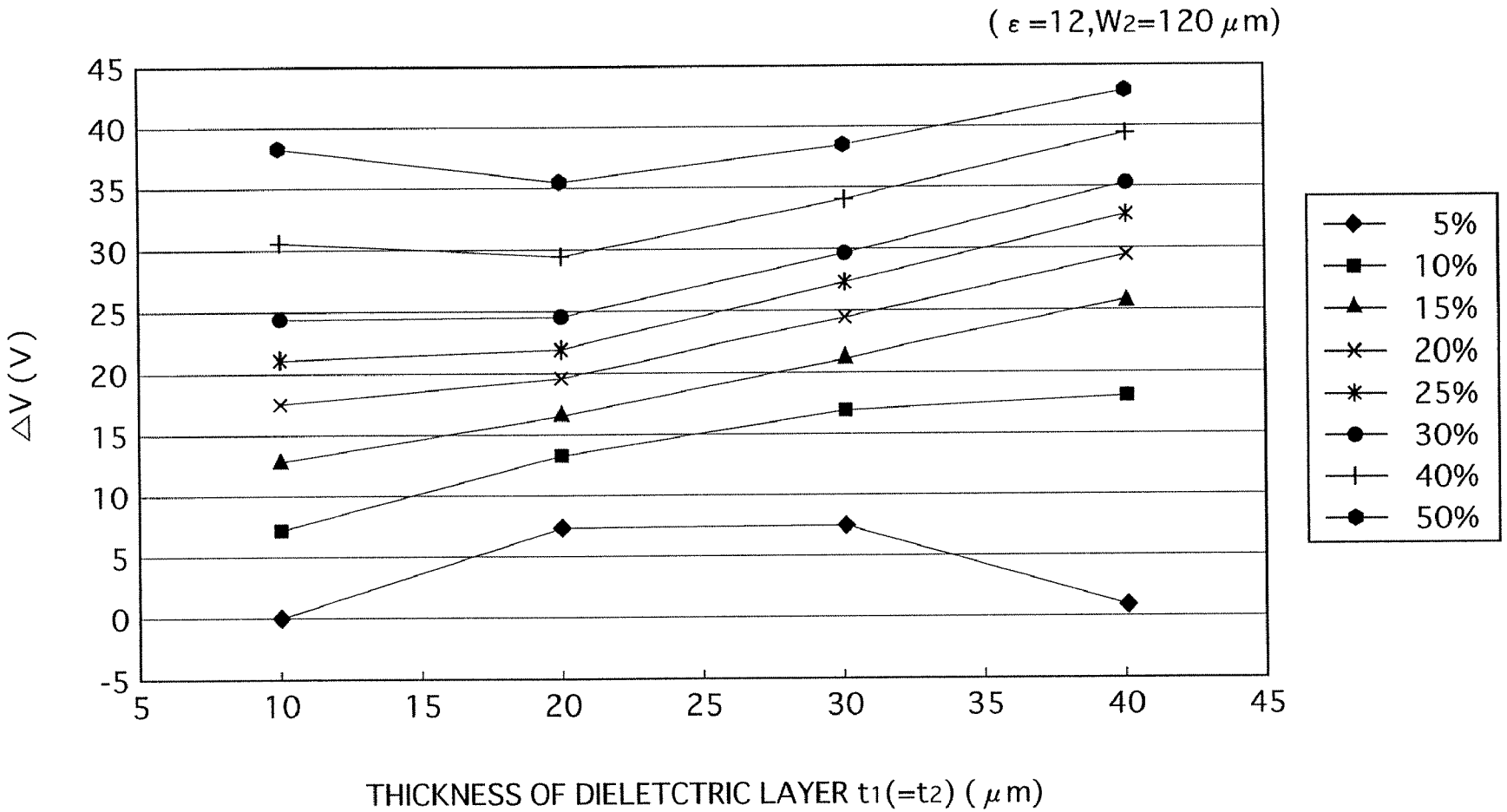
FIG. 7 shows the characteristic chart of the relationship between the discharge voltage and the thickness of the dielectric layer 104 when the relative permittivity ∈ of the dielectric layer 104 is 12.

The above preferable range of Xe partial pressure in the thicknesses $t_1$, $t_2$ of the above-described dielectric layer 104 is described with reference to FIG. 6 and FIG. 7. FIG. 6 is a characteristic chart that shows the dependency of the discharge voltage on the thicknesses $t_1$, $t_2$ of the dielectric layer 104 when the relative permittivity ∈ of the dielectric layer 104 is 7. FIG. 7 is a characteristic chart of when the relative permittivity ∈ of the dielectric layer 104 is 12.

As shown in both characteristic charts FIG. 6 and FIG. 7, to meet the conditions in which (i) the firing voltage Vf in the opposite discharge is smaller than the discharge voltage Vf' in the surface discharge, and also (ii) the electric potential difference is 20[V] or less, Xe partial pressure is in a range from 3 [kPa] to 12 [kPa]. Hence, when the thick film method is used to form the dielectric layer 104, it is preferable to set the Xe partial pressure in a range of 3 [kPa] to 12 [kPa] inclusive.

1-4. Depth D of Recessed Portion 10*a* in PDP 1

Figure 8:
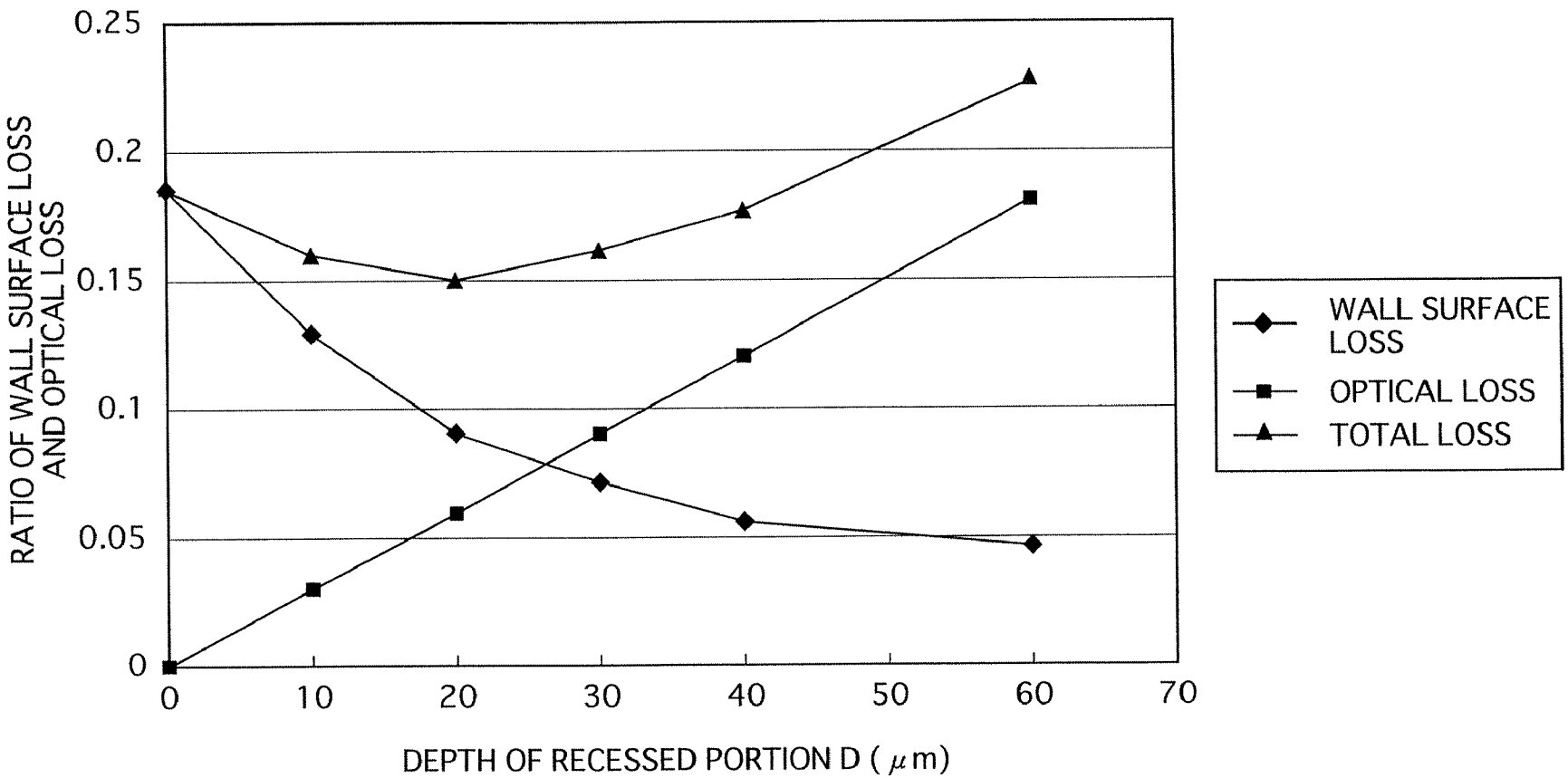
FIG. 8 shows the characteristic chart of the relationship between (i) the depth 10*a* of the recessed portion 10*a*, and (ii) the wall surface loss and the optical loss.

In the PDP 1 of the present embodiment, the following provides the descriptions of the depth D (see FIG. 2) of the recessed portion 10*a*, which is formed on the surface of the front panel 10 facing the discharge space 30, with reference to FIG. 8.

First, in the PDP 1 of the present embodiment, the recessed portion 10*a* is formed on the surface of the front panel 10 facing the discharge space 30, which makes it possible to generate the opposite discharge in the recessed portion 10*a* between the scan electrode 102 and the sustain electrode 103 when driving. The generated opposite discharge triggers the surface discharge, which can lower the discharge voltage and expand the discharge area. Therefore, in the PDP 1 of the present embodiment, it is possible to improve the luminous efficiency compared to the conventional PDPs. However, forming the recessed portions 10*a* on the surface of the front panel 10 facing the discharge space 30 includes the following advantages and disadvantages.

The advantages of forming the recessed portions 10*a* include that, when driving, it is possible to reduce the loss of excited particles generated by the discharge. On the other hand, the disadvantages thereof include that the visible light output from the phosphor layer 206 is reflected and refracted, reducing the light intensity of the visible light output through the front panel 10.

Here, the loss of excited particles means that the excited particles generated by the discharge in the discharge space 30 become deexcited by colliding with the dielectric protective layer 105 before generating ultra violet rays, resulting in reducing the amount of ultra violet rays generation (described as "wall surface loss" hereinafter). This can be solved by forming the recessed portions 10*a* on the surface of the front panel 10 facing the discharge space 30, so that it can reduce the collision between the excited particles and the wall (dielectric protective layer 105), resulting in reducing the loss of excited particles by deexcitation.

As to the reflection and the refraction of the visible light, they increase more as the depth D of the recessed portion 10*a* increases, causing low retrieval efficiency of visible light (described as "optical loss" hereinafter). FIG. 8 shows a result of a study of the depth D of the recessed portion 10*a* that was conducted based on the perspectives described above.

As shown in FIG. 8, the greater the depth D of the recessed portion 10*a* is, the smaller the wall surface loss becomes. Conversely, the greater the depth D of the recessed portion 10*a* is, the larger the optic loss becomes. Also, the total loss of the wall surface loss and the optic loss lowers contrary to the increase of the depth D when the depth D of the recessed portion 10*a* is below 20 [μm], and rises as the depth D thereof increases when the depth D is above 20 [μm]. Accordingly, it is considered that the advantage of forming the above-described recessed portions 10*a* is substantially maximized when the depth D of the recessed potion 10*a* is in a range of 10 [μm] to 30 [μm] inclusive.

1-5. Advantages of PDP 1 and The Manufacturing Method Thereof.

The below are the descriptions of advantages of the PDP 1 of the present embodiment in which the above-described manufacturing method and structure are adopted, with reference to FIG. 9, which shows the schematic sectional view that schematically describes the discharge mode during the sustain discharge period when driving the PDP 1.

Figure 9:
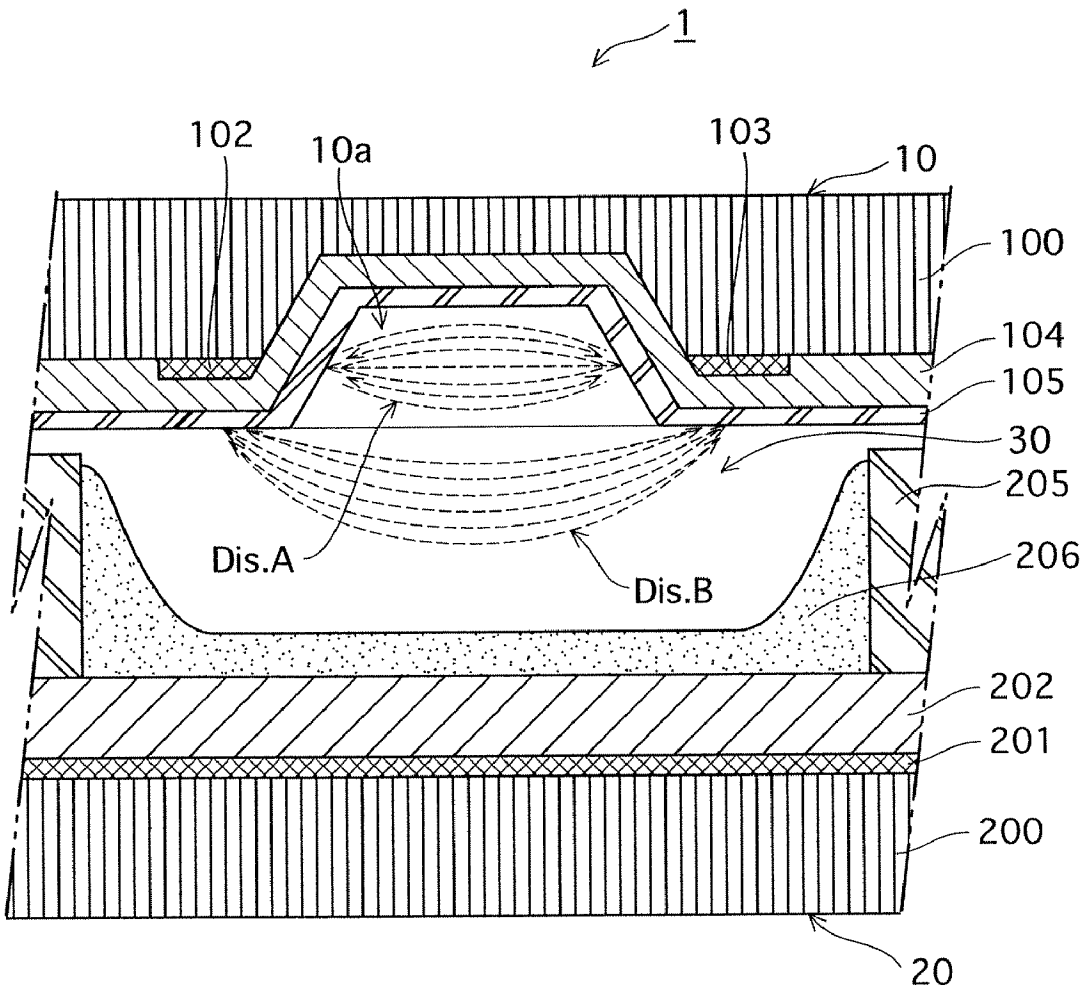
FIG. 9 shows the schematic sectional view of the discharge mode in the driving of the PDP 1.

As shown in FIG. 9, in the PDP 1 of the present embodiment, the recessed portion 10*a* is formed in such a way that the surface of the front panel 10 facing the discharge space 30 is recessed in the thickness direction of the front substrate 100. And then, the dielectric layer 104 and the dielectric protective layer 105 in the area sandwiched between the scan electrode 102 and the sustain electrode 103 are also formed along the recessed portion 10*a*. In addition, as described above, in the PDP 1 of the present embodiment, a shape and a size of the recessed portion 10*a* are described in FIG. 2.

When driving the PDP 1 that has the structure described above, opposite discharge Dis.A is generated along the path connecting the scan electrode 102 and the sustain electrode 103 at the recessed portion 10*a* in each discharge cell that is selected during the sustain discharge period. Then, the generated opposite discharge Dis.A becomes a trigger to generate surface discharge Dis.B along an arc shaped path connecting the scan electrode 102 and the sustain electrode 103 outside the recessed portion 10*a*. In brief, in the PDP 1, during the sustain discharge period, it is possible to generate the opposite discharge Dis.A first, and then generate the surface discharge Dis.B based on the opposite discharge Dis.A; therefore, it is possible to reduce the electric power consumption by improving the luminous efficiency while suppressing the increase of the firing voltage. Additionally, as to the setting values in the PDP 1 of the present embodiment, it is preferable to set the values in such a way that the firing voltage Vf in the opposite discharge Dis.A is lower than the firing voltage Vf' in the surface discharge Dis.B. Also, it is preferable to set the difference between the firing voltage Vf in the opposite discharge Dis.A and the firing voltage Vf' in the surface discharge Dis.B to 20[V] or less. This is for the following reasons.

The phenomenon where the surface discharge Dis.B is triggered by the opposite discharge Dis.A is caused by a mechanism in which the firing voltage Vf' of the surface discharge Dis.B is lowered by electrons, ions and excited particles that are generated by the opposite discharge Dis.A.

However, the amount of a decrease in the above-described firing voltage Vf' has a limit. Hence, if the difference between the firing voltage Vf and the firing voltage Vf' is too large, only the opposite discharge Dis.A is generated and it does not develop into the surface discharge Dis.B. Consequently, the opposite discharge Dis.A ends up being a localized discharge mode. The present inventors have discovered that it is possible to develop the opposite discharge Dis.A into the surface discharge Dis.B as far as an electric potential difference between the firing voltage Vf of the opposite discharge Dis.A and the firing voltage Vf' of the surface discharge Dis.B is 20[V] or less.

Also, in the PDP 1 of the present embodiment in which the opposite discharge Dis.A is used as a trigger to generate the surface discharge Dis.B, it is possible to lengthen the discharge path of the surface discharge Dis.B and enlarge the area of positive column.

Also as described above, in the PDP 1, the scan electrode 102 and the sustain electrode 103 are arranged so as to sandwich the recessed portion 10*a* there between. Here, both of the scan electrode 102 and the sustain electrode 103 are arranged to be inside the sub walls 205 so that it is possible to keep the low capacitance between (i) the scan electrode 102 and the sustain electrode 103, and (ii) the back panel.

It should be noted that, in the PDP 1 of the present embodiment, the scan electrodes 102 and the sustain electrodes 103 have a structure that includes a metallic material as the main component. However, as seen in the PDP 1 of the present embodiment, if the discharge mode is applied in which the opposite discharge Dis.A develops into the surface discharge Dis.B when driving, it is not necessary to have the structure in which each of the scan electrode 102 and the sustain electrode 103 does not contain ITO, $SnO_2$, or ZnO (a structure that includes only bus lines). In other words, each scan electrode and sustain electrode can have a structure that is used for the conventional PDPs.

Second Embodiment

The following is the descriptions of the second embodiment of the present invention.

2-1. Structure of PDP 2

Figure 10:
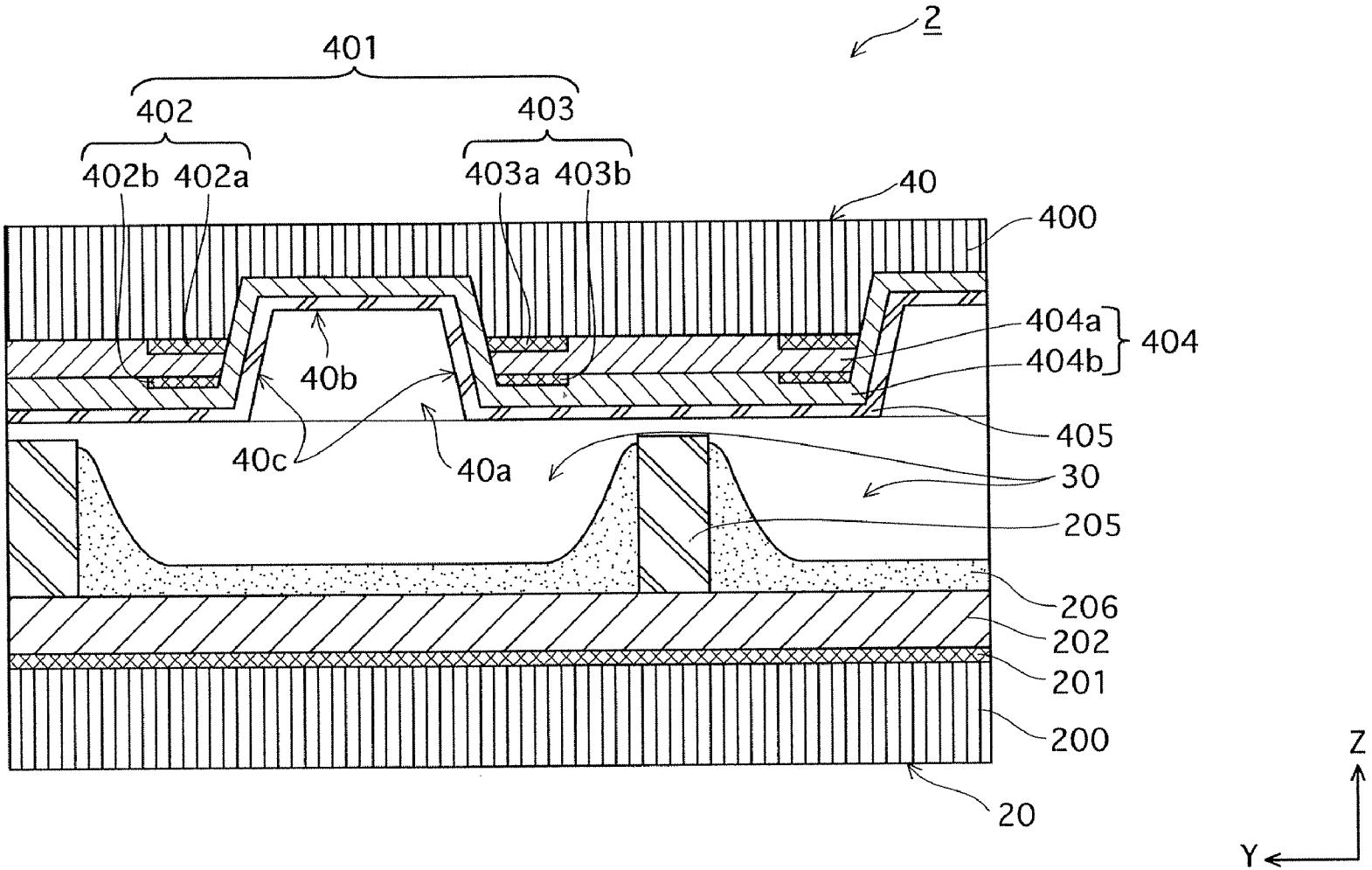
FIG. 10 shows the sectional view of the main part of the PDP 2 of the second embodiment.

The following are the descriptions of the PDP 2 of the second embodiment with reference to FIG. 10. FIG. 10 shows the sectional view of the main part of the PDP 2 of the second embodiment. It should be noted that the PDP 2 of the present embodiment has differences from the PDP 1 of the above-described first embodiment in scan electrodes 402, sustain electrodes 403, and a dielectric layer 404. Therefore, the descriptions are focused on these differences, and the descriptions that overlap with the above-described first embodiment are omitted here.

As shown in FIG. 10, as to a front panel 40 of the PDP 2, the scan electrode 402 is a combination of a scan electrode first element layer 402*a* and a scan electrode second element layer 402*b*, which are arranged separately from each other in the thickness direction of a front substrate 400. Also, in the PDP 2, the sustain electrode 403 is a combination of a sustain electrode first element layer 403*a* and a sustain electrode second element layer 403*b*. It should be noted that the figures of the following descriptions are omitted here. The scan electrode first element layer 402*a* and the scan electrode second element layer 402*b* that are included in the scan electrode 402, for example, are connected electrically at the outer edges of the panel, so that the both of the layers are at the same electric potential when driving. Also, the sustain electrode first element layer 403*a* and the sustain electrode second element layer 403*b* are electrically connected there between.

A dielectric first element layer 404*a* is interposed between the scan electrode first element layer 402*a* and the scan electrode second element layer 402*b* that are included in the scan electrode 402, and also between the sustain electrode first element layer 403*a* and the sustain electrode second element layer 403*b* that are included in the sustain electrode 403. Also, the scan electrode second element layer 402*b* and the sustain electrode second element layer 403*b* are both covered by a dielectric second element layer 404*b*. In the PDP 2, a dielectric layer 404 is a combination of the dielectric first element layer 404*a* and the dielectric second element layer 404*b*. Then, a dielectric protective layer 105 is formed along a surface of the dielectric second element layer 404*b*.

As shown in FIG. 10, the PDP 2 of the present embodiment has a structure in which the dielectric second element layer 404*b* and the dielectric protective layer 405 are recessed in the thickness direction of the front substrate 400, in the area that is sandwiched between the scan electrode 402 and the sustain electrode 403 in the front panel 40, to form a recessed portion 40*a*. The detailed structure is the same as the first embodiment that is described above.

As to the scan electrode 402 and the sustain electrode 403 on the above-described front panel 40, both of (i) the first element layers 402*a*,403*a* and (ii) the second element layers 402*b*,403*b* that are included in each electrode, are formed with a metallic material. This is the same as the structure of the first embodiment in which each of the scan electrode 102 and the sustain electrode 103 of the above-described embodiment includes only a metallic material, and it is possible to use a metallic material such as Ag, or Cr—Cu—Cr. In addition, each of the element layers (i) 402*a*,402*b* that are included in the scan electrode 402, and (ii) 403*a*,403*b* that are included in the sustain electrode 403 is formed to be arranged closer to the discharge space 30 than the bottom surface 40*b* of the recessed portion 40*a*.

The back panel 20 is formed in the same way as the back panel 20 of the PDP 1 of the first embodiment that is described above. Also the same as those of the PDP 1 of the first embodiment that is described above are (i) the composition of the discharge gas that is filled in the discharge space 30, and (ii) the charge pressure.

2-2. Manufacturing Method of PDP 2

The following is the manufacturing method of the PDP 2 that has the above-described structure with reference to FIGS. 11A to 11C and FIGS. 12A to 12B. It should be noted that, as to the structure of the back panel 20, as described above, it is the same as the structure of the PDP 1 of the first embodiment that is described above. Therefore, the following is the manufacturing method of the PDP 2 that only concerns the front panel 40.

Figure 11A:
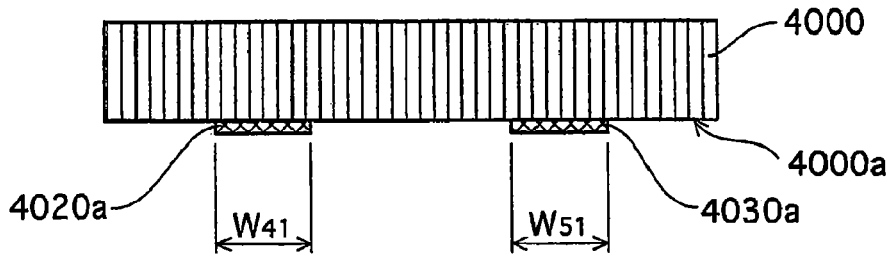
FIGS. 11A to 11C shows the schematic process chart of the manufacturing process of the PDP 2.

As shown in FIG. 11A, on one of the main surfaces 4000*a* of the glass substrate 4000, each electrode film 4020*a* and electrode film 4030*a* is arranged parallel to each other with a predetermined interval inbetween. To form both of the electrode films 4020*a* and 4030*a*, as is the case with the electrode films 1020 and 1030 of the first embodiment described above, it is possible to use a metallic material such as Cr—Cu—Cr or Ag (materials that allow other substances to be mixed on the level of impurity, and a major component thereof is metal). In other words, even in the manufacture of the PDP 2 of the present embodiment, the materials such as ITO (Indium Tin Oxide), $SnO_2$ or ZnO, which are used for manufacturing front panels of conventional PDPs, are not adopted. The widths of the electrode films 4020*a* and 4030*a* are referred to as widths $W_{41}$ and $W_{51}$, and are wider than each of the electrode widths.

It should be noted here that, to form the electrode films 4020*a* and 4030*a*, as is the case with the above, a sputtering method is adopted when the material used is Cr—Cu—Cr; and if the material used is Ag, it is preferable to use the printing method.

Figure 11B:
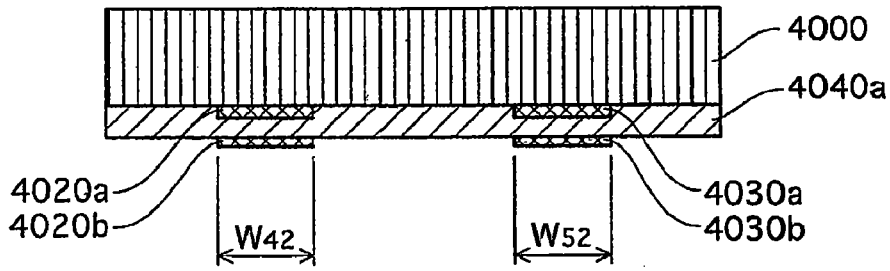

Secondly, as shown in FIG. 11B, a dielectric preparation film 4040*a* is formed as to cover the main surface 4000*a* of the glass substrate 4000 in which the electrode films 4020*a* and 4030*a* are formed. And then, as is the case with the electrode films 4020*a* and 4030*a*, the electrode films 4020*b* and 4030*b* that are made of a metallic material are further formed onto the dielectric preparation film 4040*a*. Here, (i) the electrode films 4020*a*, 4030*a* that are formed on a boundary between the glass substrate 4000 and the dielectric preparation film 4040*a*, and (ii) the electrode films 4020*b*, 4030*b* that are formed on the surface of the dielectric preparation film 4040*a*, are formed to overlap each other in a size and a position when seen in the thickness direction of the dielectric preparation film 4040*a*. Therefore, the width $W_{42}$ of the electrode film 4020*b* and the width $W_{52}$ of the electrode film 4030*b* are substantially equivalent as the above-described width $W_{41}$ and the width $W_{51}$. Also, the end positions of the electrode films 4020*b* and 4030*b* are formed to match each other in the direction of the main surface of the glass substrate 4000.

Figure 11C:
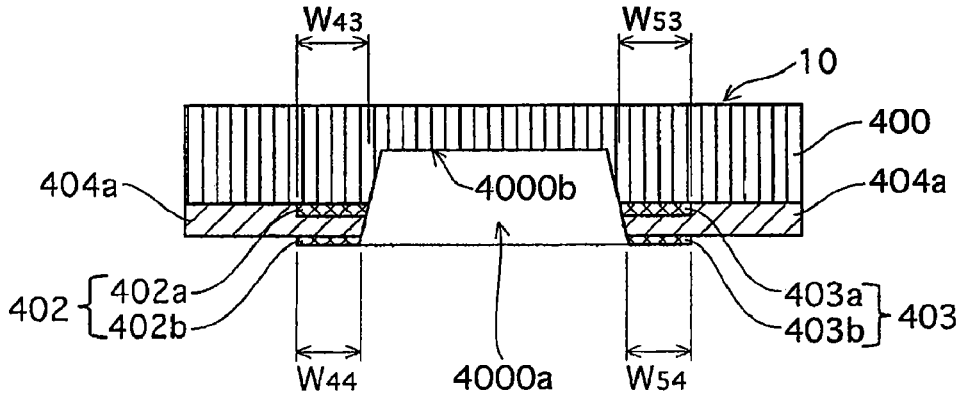

Then, as shown in FIG. 11C, parts of (i) the dielectric preparation film 4040*a* and the glass substrate 4000, which are located in the area sandwiched between the forming area of the electrode films 4020*a*, 4020*b*, and (ii) the forming area of the electrode films 4030*a* and 4030*b* are patterned up to the bottom surface 4000*b*, so that the recessed portion 4000*a* is formed. At this time, the sides of the recessed portion 4000*a*, as is the case with the side surfaces 10*c* of the recessed portion 10*ab* of the PDP 1 of the first embodiment described above, have angles and thus form slopes.

For patterning the dielectric preparation film 4040*a* and the glass substrate 4000, as same as the above, the sandblasting method can be adopted. In this patterning, part of electrode films 4020*a*, 4020*b*, 4030*a* and 4030*b* in the width direction is also removed.

After the patterning, each of (i) the scan electrode first element layer 402*a* and the scan electrode second element layer 402*b* that are included in the scan electrode 402, and (ii) the sustain electrode first element layer 403*a* and the sustain electrode second element layer 403*b* that are included in the sustain electrode 403, are formed to face the recessed portion 4000*a*.

Also, in this condition, the sides of the first and second element layers 402*a*, 402*b*, 403*a* and 403*b* of the electrodes 402 and 403 that are on the side of the recessed portion 4000*a* are exposed to the space in the recessed portion 4000*a*. It should be noted that the widths of (i) the first element layer 402*a* of the scan electrode 402 and (ii) the first element layer 403*a* of the sustain electrode 403 are referred to as the widths $W_{43}$, $W_{53}$, and are respectively wider than the widths $W_{44}$, $W_{54}$ of the second element layers 402*b*, 403*b*.

Figure 12A:
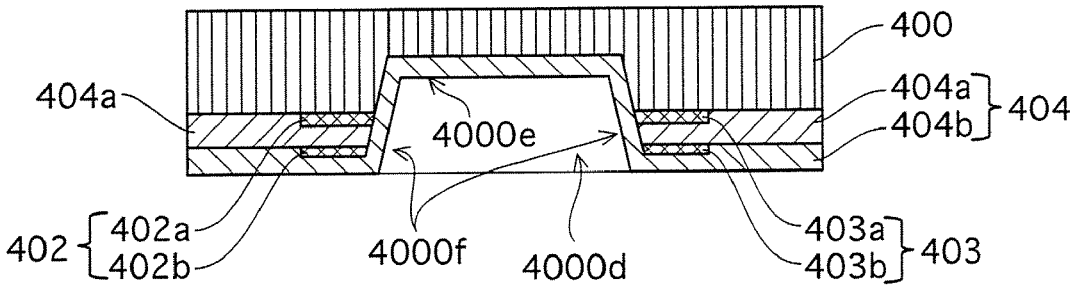
FIGS. 12A to 12B shows the schematic process chart of the manufacturing process of the PDP 2.

As shown in FIG. 12A, the dielectric layer 404 is a combination of (i) the dielectric second element layer 404*b* that is formed along the patterned surface and (ii) the dielectric first element layer 404*a* that has been formed before the dielectric second element layer 404*b*.

To form the dielectric second element layer 404*b*, it is possible to adopt the paste coating method. However, to secure the uniformity of the film thickness of the dielectric layer, it is preferable to adopt the method of using a dielectric material in a form of a sheet. That means, when the method is adopted in which the dielectric material in a form of a sheet is used, the thicknesses of the sides 4000*f* of the recessed portions 4000*d* shown in the FIG. 12A are equalized over the whole panel. In the present embodiment in which the distances between (i) the scan electrodes 402 and the sustain electrodes 403 and (ii) the surfaces of the recessed portions 40*a* are equalized over the whole panel, it is possible (i) to decrease the variation of the discharge characteristics between the discharge cells and (ii) to improve the picture quality.

It should be noted that, after the dielectric second element layer 404*b* is formed, the bottom surface 4000*e* of the recessed portion 4000*d* is kept more inward in the thickness direction of the front substrate 400 than each of the positions in which the first element layers 402*a*, 403*a* of the scan electrode 402 and the sustain electrode 403 is formed. In addition, when the dielectric material in a form of a sheet is used to form the dielectric second element layer 404*b*, the thickness thereof may be equivalent in a range of 20 [μm] to 40 [μm] inclusive.

Figure 12B:
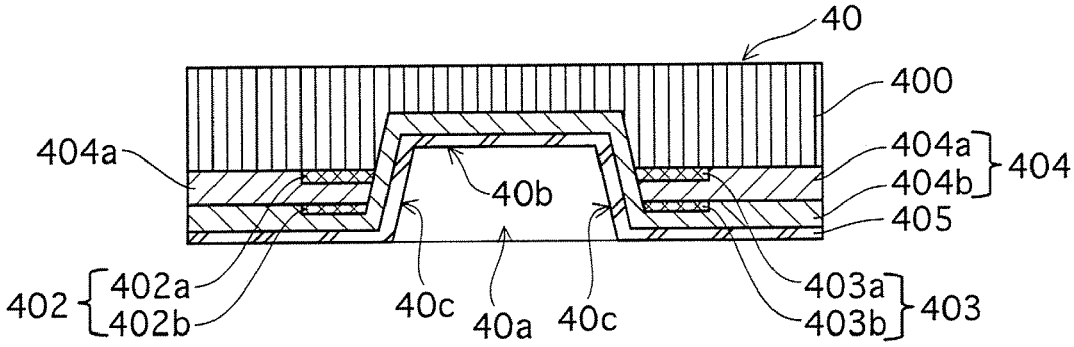

Then, as shown in FIG. 12B, the dielectric protective layer 405 is formed along the surface of the dielectric second element layer 404*b* that includes the bottom surface 4000*e* of the recessed portion 4000*d* and the sides 4000*f* thereof. The dielectric protective layer 105 is, as is the case with the above-described manufacturing method of first embodiment, for example, formed with at least one material out of the material group that includes Mg, $MgAl_2O_4$, SrO, AlN and $La_2O_3$, by using an electron beam evaporation method or an ion gun deposition method.

It should be noted that, in the present embodiment, the sides 40*c* of the recessed portion 40*a* also form slopes with angles with respect to the thickness direction of the front substrate 400. Therefore, the dielectric protective layer 405, in the sides 40*c* of the recessed portion 40*a*, has higher crystallinity and more regulated crystalline orientation than the other parts, and also has a large secondary electron emission characteristic (large secondary electron emission coefficient ν).

Finally, the front panel 40 that is formed through each of the process described above is placed so as to face the back panel 20 that has been formed before the front panel 40 through the different process, and then sealed at the outer periphery. The filling pressure of the discharge gas for the discharge space 30 and the composition thereof are the same as the PDP 1 of the first embodiment described above.

2-3. Advantages PDP 2 and Manufacturing Method Thereof

Figure 13:
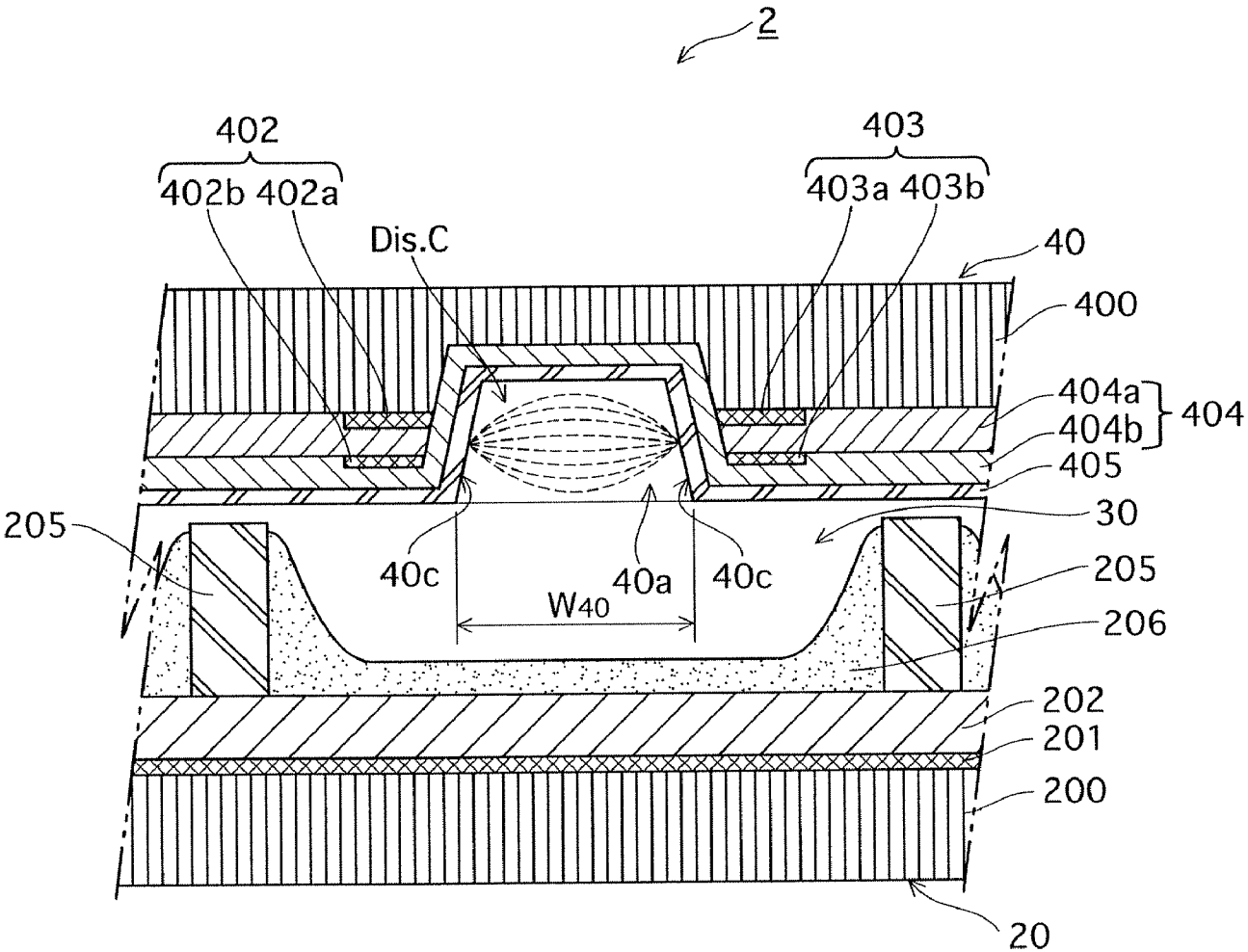
FIG. 13 shows the schematic sectional view of the discharge mode in the driving of the PDP 2.

The below are the descriptions of advantages of the PDP 2 of the present embodiment, which has the above-described structure by using the above-described manufacturing method, with reference to FIG. 13. FIG. 13 shows the schematic sectional view that schematically describes the discharge mode during the sustain discharge period when driving the PDP 2.

As shown in FIG. 13, in the PDP 2 of the present embodiment, the recessed portion 40*a* is formed in such a way that the surface of the front panel 40 that faces the discharge space 30 is recessed in the thickness direction of the front substrate 400. And then, (i) the dielectric second element layer 404*b*, and (ii) the dielectric protective layer 405 in the area sandwiched between the scan electrode 402 and the sustain electrode 403, are also formed along the recessed portion 40*a*. Additionally, in the PDP 2, the structures of the scan electrode 402 and the sustain electrode 403 are different from the PDP 1 of the above-described first embodiment in such a way that each of the scan electrode 402 and the sustain electrode 403 is separated in two layers of (i) the electrode first element layers 402*a*, 403*a* and (ii) the electrode second element layers 402*b*, 403*b*, with the dielectric first element layer 404*a* interposed inbetween.

In addition, (i) both of the scan electrode first element layer 402*a* and the scan electrode second element layer 402*b* that are included in the scan electrode 402, and (ii) both of the sustain electrode first element layer 403*a* and the sustain electrode second element layer 403 are, as described above, electrically connected at the outer edges of the panel and such, so as to be in the same electric potential state each other (not shown).

In the driving of the PDP 2 that has the above-described structure, when a pulse voltage is impressed between the scan electrodes 402 and the sustain electrodes 403 in the sustain discharge period during the discharge cells that are selected during the address period prior to the sustain discharge period, the opposite discharge Dis.C is generated between the both sides 40*c* of the recessed portion 40*a*. Then, in the PDP 2 of the present embodiment, the opening width $W_{40}$ of the recessed portion 40*a* is set to 200 [μm] or above. Therefore, in the PDP 2 of the present embodiment, as opposed to the PDP 1 of the above-described first embodiment, it is the opposite discharge Dis.C that is mainly generated, and the surface discharge is hardly ever generated after that.

Here, although it is not shown in FIG. 13, a distance (discharge gap) between the scan electrode 402 and the sustain electrode 403 that are arranged to interpose the recessed portion 40*a* is defined by the opening width $W_{40}$ (=200 [μm]) of the recessed portion 40*a*; and set to be, for example, in a range of the above-described opening width $W_{40}$ to 300 [μm] inclusive.

In this way, in PDP 2, during the sustain discharge period, the opposite discharge Dis.C can be generated in the space of the respective recessed portions 40*a* which are sandwiched between the scan electrodes 402 and the sustain electrodes 403. Therefore, it is possible to reduce the power consumption by improving the luminous efficiency while suppressing the increase of the firing voltage.

Also, in the PDP 2, it is possible to (i) lengthen the discharge path of the opposite discharge Dis.C in accordance with the opening width $W_{40}$ of the recessed portion 40*a*, and (ii) increase the positive column area. Although data of the following statement is omitted, according to the findings of the inventors hereof, as described in the PDP 2 of the present embodiment, it is preferable to set the opening width $W_{40}$ of the recessed portion 40*a* to 200 [μm] or above from the perspective of improving the luminous efficiency. However, if the opening width $W_{40}$ is increased too much, the respective forming areas of the scan electrode 402, the sustain electrode 403 and the sub barrier rib 205 are overlapped. Subsequently, the capacity between the back panel and the recessed portion 40*a* becomes too large. Therefore, in the PDP 2, it is important to set the opening width $W_{40}$ of the recessed portion 40*a* in such a way that an increase of reactive power stays within a range that is realistically acceptable.

In addition, in the PDP 2 of the present embodiment, as described above, the scan electrodes 402 and the sustain electrodes 403 have a multi layer structure. Therefore, compared to the PDPs in which electrodes that are thicker than a dielectric layer are formed by using a plating method and such, as seen in the above-described Patent Document 2, it is possible to generate sufficient opposite discharge without widening the widths of the scan electrodes 402 and the sustain electrodes 403. Accordingly, in the PDP 2 of the present embodiment, compared to the conventional PDPs of the above-described Patent Document 2, visible light that is generated in the discharge cells are less interrupted by the scan electrodes 402 and the sustain electrodes 403; and thus it is an advantage from the perspective of the luminous efficiency. Also, as shown in FIG. 13, (i) each of the scan electrode first element layer 402*a* and the scan electrode second element layer 402*b* that is included in the scan electrode 402, and (ii) each of the sustain electrode first element layer 403*a* and the sustain electrode second element layer 403*b* that is included in the sustain electrode 403 is formed to overlap almost entirely each other in the thickness direction of the dielectric first element layer 404*a* and the dielectric second element layer 404*b*. Therefore, it is possible to minimize the blocking of visible light.

"overlap almost entirely each other" as described above means the state shown in FIG. 13, in which there are slight shifts between each side edge of the first element layers of the electrode 402*a*,403*b* and the second element layers of the electrodes 402*b*,403*b* on the sides of the recessed portion 40*a*, and each other end of the side edges is overlapped perfectly.

From the perspective of a forming method of the electrodes 402,403, in the PDP 2, it is possible to set the width to substantially 40 [μm] with the thickness ranging from submicron to several microns with use of a sputtering method or a printing exposure method. Therefore, from the perspective of such manufacturing methods, in the PDP 2 of the present embodiment, the ratio of blocking visible light is low, and it is advantageous to the improvement of luminous efficiency.

Additionally, as described above, in the PDP 2, the arrangement of the scan electrode 402 and the sustain electrode 403 is set to the position in which the recessed portion 40*a* is sandwiched. The arrangement thereof is also set to be inside the sub barrier rib 205, so that electric capacitance between the back panel and the electrodes 402,403 can be maintained low.

It should be noted that, in the PDP 2 of the present embodiment, each of the scan electrode 402 and the sustain electrode 403 is a combination of the first element layers of the electrode 402*a*,403*a*, and a combination of the second element layers of the electrode 402*b*,403*b*, as described above. However, it is not limited to such. For example, each of the scan electrode 402 and the sustain electrode 403 may be a combination of the electrode layers of three or more layers that are separated each other. In this way, the more the number of element layers of the scan electrode 402 and the sustain electrode 403 is increased, the larger the discharge area for opposite discharge Dis.C during the sustain discharge period can be. Accordingly, it is possible to generate more ultra violet rays. However, since the manufacturing process of forming the electrodes is complicated, it is necessary to take into consideration the relationship with the manufacturing cost.

Also, as shown in FIG. 10, the PDP 2 of the present embodiment has a structure in which the bottom surface 40*b* of the recessed portion 40*a* is kept more inward in the thickness direction of the front substrate 400 than the first element layers of the electrode 402*a*, 403*a* of the scan electrode 402 and the sustain electrode 403, as described above. However, as to the bottom surface 40*b* of the recessed portion 40*a*, it is possible to adopt the structure in which the bottom surface 40*b* of the recessed potion 40*a* is located between the first element layers of the electrode 402*a*, 403*a* and the second element layers of the electrode 402*b*,403*b*. In this case, again, it is possible to generate the opposite discharge Dis.C along the path connecting the scan electrode 402 and the sustain electrode 403 during the sustain discharge period.

Third Embodiment

3-1. The Structure of PDP 3

Figure 14:
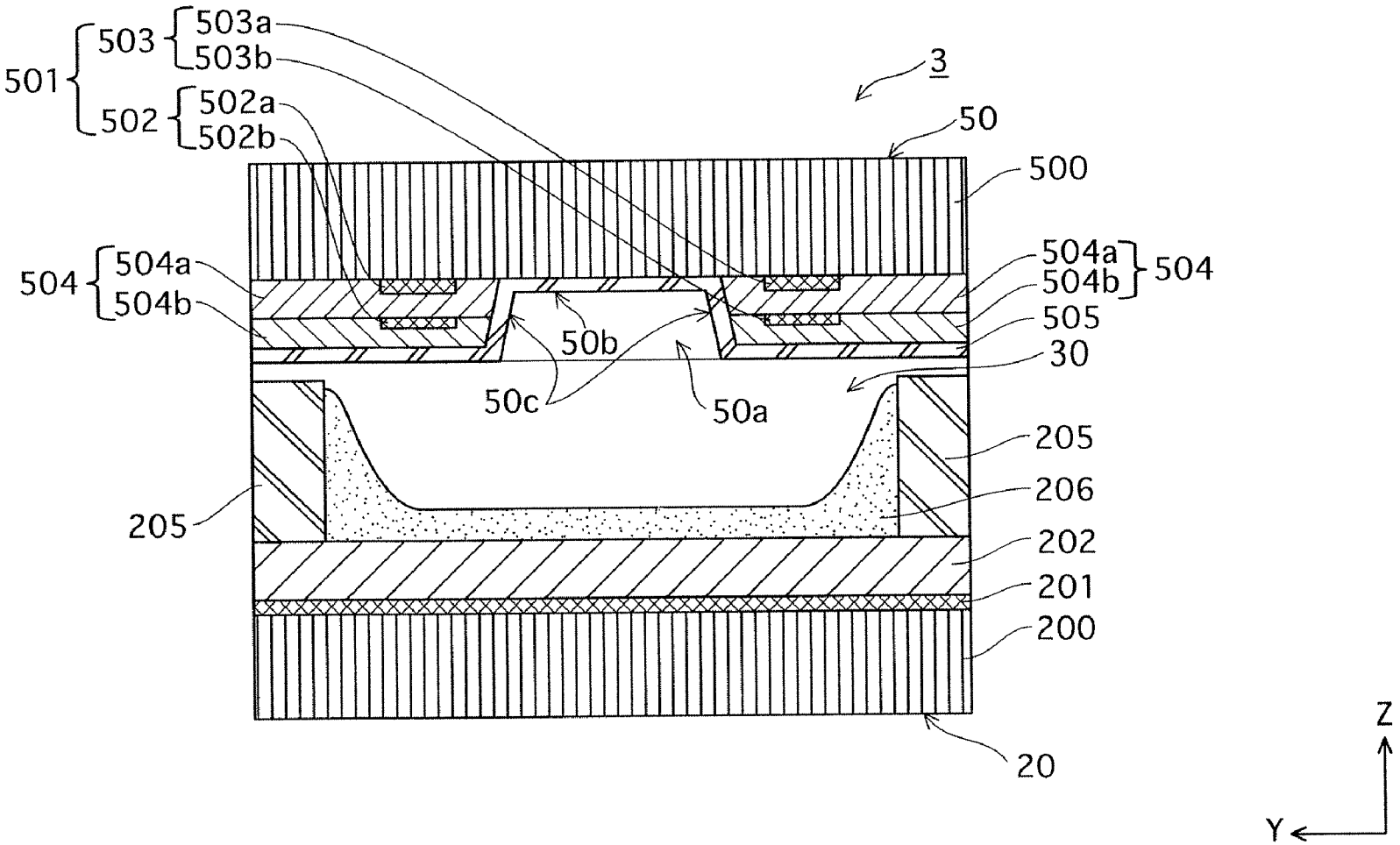
FIG. 14 shows the sectional view of the main part of the PDP 3 of the third embodiment.

The following is the descriptions of the PDP 3 of the third embodiment with reference to FIG. 14. It should be noted that, in the PDP 3 of the present embodiment, a structure of a front panel 50 is different from the above-described PDP 1 and PDP 2. Therefore, the following provides the descriptions in which the front panel 50 is mainly discussed. In addition, as to the each part that has the same structure as the above-described PDP 1 and PDP 2, the same code is applied and the descriptions thereof are omitted.

As shown in FIG. 14, out of the both panels 50 and 20 that are included in the PDP 3, the front panel 50 includes a scan electrode 502 and a sustain electrode 503 that are the combinations of (i) the first element layers of the electrode 502*a*, 503*a* and (ii) the second element layers of the electrode 502*b*, 503*b*, which are arranged separately from each other. (i) The scan electrode first element layer 502*a* and the second element layer 502*b* in the scan electrode 502, and (ii) the sustain electrode first element layer 503*a* and the second element layer 503*b* in the sustain electrode 503, are electrically connected respectively.

Additionally, in the area sandwiched between the scan electrode 502 and the sustain electrode 503, the inner surface of the panel 50 is recessed in the thickness direction of the front substrate 500 (upward in z axial direction), so that the recessed portion 50*a* is formed. At the bottom surface 50*b* and the sides 50*c* of the recessed portion 50*a*, the dielectric protective layer 505 is exposed to the space. Then, in each scan electrode 502 and sustain electrode 503, the electrode first element layers 502*a*, 503*a* are formed on the main surface of the front substrate 500, and the electrode second element layers 502*b*, 503*b* are formed on the boundary between the dielectric first element layer 504*a* and the dielectric second element layer 504*b*.

At the bottom surface 50*b* of the recessed portion 50*a*, the dielectric protective layer 505 is placed directly on the main surface of the front substrate 500.

It should be noted that, in the PDP 3 of the present embodiment, the opening width of the recessed portion 50*a* is at least 200 [μm].

3-2. A Manufacturing Method of PDP 3

The following is the description of the manufacturing method of the PDP 3 that has the above-described structure with reference to FIGS. 15A to 15C and FIGS. 16A to 16B.

Figure 15A:
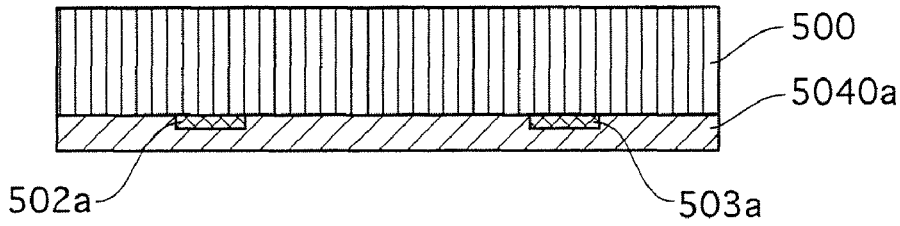
FIGS. 15A to 15C shows the schematic process chart of the manufacturing process of the PDP 3.

As shown in FIG. 15A, in the manufacture of the PDP 3, the first element layers of the electrode 502*a*,503*a* are formed on one of the main surfaces of the front substrate 500. The electrode materials used for forming the first element layers 502*a*,503*a* include Cr—Cu—Cr or Ag, as is the case with the above-described first and second embodiments; and the forming method thereof may include a sputtering method and a printing method. Then, the dielectric preparation film 5040*a* whose thickness is in a range of 20 [μm] to 40 [μm] inclusive, is formed to cover the main surface of the front substrate 500 that includes the first element layers of the electrode 502*a*, 503*a*, with use of a photosensitive dielectric material in a form of a sheet.

Figure 15B:
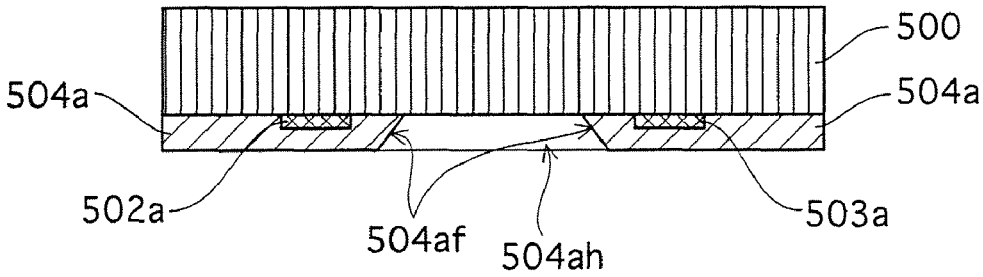

Secondly, as shown in FIG. 15B, the area sandwiched between the scan electrode first element layer 502*a* and the sustain electrode first element layer 503*a* in the dielectric preparation film 5040*a* is dug down to the level in which the main surface of the front substrate 500 is exposed, to form the recessed portion 504*ah*. To form the recessed portion 504*ah*, for example, it is possible to use an exposure and development method. Here, in the manufacture of the PDP 3 of the present embodiment, each side edge of the electrode first element layers 502*a*,503*a* is not exposed on the side surfaces 504*af* of the recessed portion 504*ah* in the formation step of the recessed portion 504*ah*. This makes it possible to form the dielectric first element layer 504*a* that includes the recessed portion 504*ah* having the main surface of the front substrate 500 as the bottom surface.

Figure 15C:
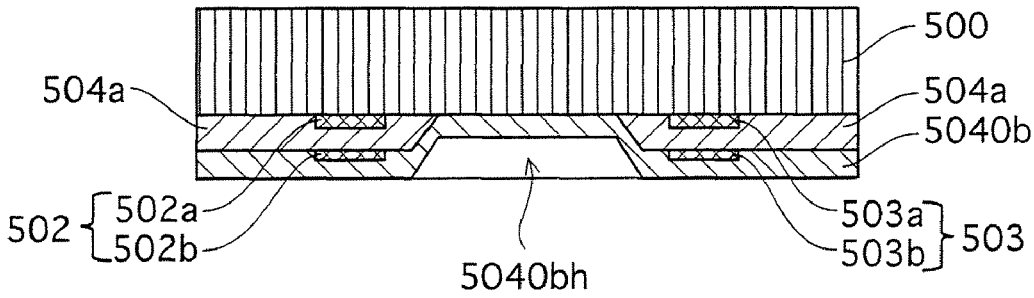

As shown in FIG. 15C, the scan electrode second element layer 502*b* and the sustain electrode second element layer 503*b* are formed on the areas of the main surface of the dielectric first element layer 504*a*, which correspond to the scan electrode first element layer 502*a* and the sustain electrode first element layer 503*a* respectively.

Again, in the PDP 3 of the present embodiment, as is the case with the PDP 2 of the above-described second embodiment, (i) the scan electrode first element layer 502*a* is paired with the scan electrode second element layer 502*b* to form the scan electrode 502, and (ii) the sustain electrode first element layer 503*a* is paired with the sustain electrode second element layer 503*b* to form the sustain electrode 503. It should be noted that the scan electrode first element layer 502*a* and the scan electrode second element layer 502*b* that are included in the scan electrode 502 are electrically connected to each other. In the same manner, the sustain electrode first element layer 503*a* and the sustain electrode second element layer 503*b* that are included in the sustain electrode 503 are electrically connected to each other. These electric connections are established, for example, at the outer edges of the panel.

In addition, as shown in FIG. 15C, the dielectric preparation film 5040*b* is formed along (i) the main surface of the dielectric first element layer 504*a*, (ii) the inner wall surfaces of the recessed portion 504*ah*, and (iii) the exposed main surface of the front substrate 500, covering the second element layers of the electrode 502*b*,503*b*, with use of a photosensitive material in a form of a sheet, in a range of 20 [μm] to 40 [μm] inclusive. Here, in the area sandwiched between the scan electrode 502 and the sustain electrode 503, the dielectric preparation film 5040*b* is formed along the recessed portion 504*ah* of the dielectric first element layer 504*a* described above, the corresponding parts being recessed in the thickness direction of the front substrate 500 (upward in z axial direction) to form the recessed portion 5040*bh*.

Figure 16A:
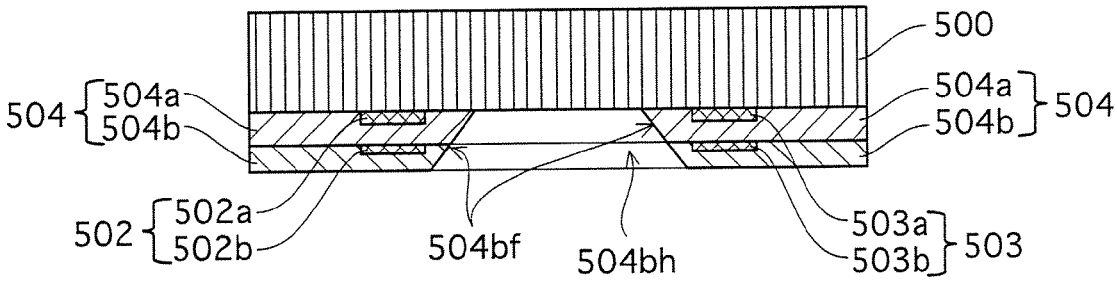
FIGS. 16A to 16B shows the schematic process chart of the manufacturing process of the PDP 3.

Next, as shown in FIG. 16A, part that corresponds to the above-described recessed portion 5040*bh* in the dielectric preparation film 5040*b* is removed with use of an exposure and development method to form the recessed portion 504*bh*, thereby completing the dielectric second element layer 504*b*. As a result, the dielectric first element layer 504*a* is paired with the second element dielectric layer 504*b* to form the dielectric layer 504. As the same manner as the above, each side edge of (i) the first element layers of the electrode 502*a*, 503*a* and (ii) the second element layers of the electrode 502*b*, 503*b* should not be exposed to the side surfaces 504*bf* of the recessed portion 504*bh*.

Figure 16B:
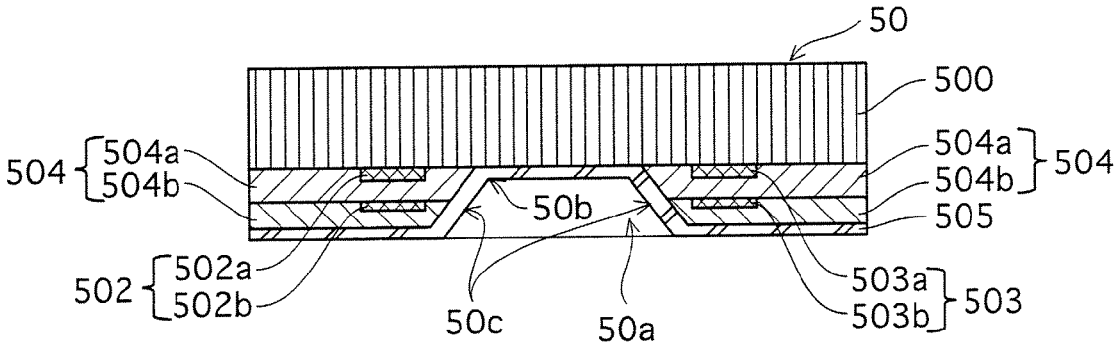

As shown in FIG. 16B, the dielectric protective layer 505 is formed along (i) the main surface of the dielectric second element layer 504*b*, (ii) the sides 504*bf* of the recessed portion 504*bh*, and (iii) the exposed area of the main surface of the front substrate 500. As is the case with the above-described embodiments 1 and 2, the dielectric protective layer 505 is formed with at least one material out of the material group that includes Mg, $MgAl_2O_4$, SrO, AlN and $La_2O_3$as a main material, with use of an electron beam evaporation method, an ion gun deposition method and such. A front panel 50, thereby includes recessed portions 50*a*, each of which is formed in such a manner that the surface between the scan electrode 502 and the sustain electrode 503 facing toward the space is recessed in the thickness direction of the front substrate 500. The bottom surface 50*b* and the side surfaces 50*c* of the recessed portion 50*a* are covered with the dielectric protective layer 505. As is the case with each of the front panels 10, 40 of the above-described PDP 1, PDP 2, the sides 50*c* of the recessed portion 50*a* have inclined flat surfaces. Therefore, an oblique deposition method is used to form the dielectric protective layer 505. As a result, the obliquely deposited part of the dielectric protective layer 505 has an excellent secondary electron emission characteristic due to the higher crystallinity and the more regulated orientation than the part which is not deposited obliquely.

It should be noted here that the figures related to the following descriptions are omitted. As is the case with the above-described first and other embodiments, the front panel 50 is arranged so as to face the back panel 20 that has been formed in advance, sealing the outer periphery thereof. Then, a continuous hole is formed to move gas in and out to/from the discharge space 30 that has been formed by sealing. After the gas remaining in the discharge space 30 has been exhausted through the continuous hole, discharge gas such as Xe—Ne based gas mixture is filled until the internal pressure in the discharge space 30 becomes substantially 60 [kPa]. To exhaust the residual gas and filling the discharge gas, the heights of sub barrier ribs 205 are formed to be slightly lower than the main barrier ribs 204 so as to secure the good gas circulation. Finally, the continuous hole is sealed to complete the PDP 3.

It should be noted that, when manufacturing the PDP 3 of the present embodiment, the component ratio of Xe in the discharge gas is preliminarily adjusted in a way that the partial pressure thereof becomes 6 [kPa].

3-3. Advantages of PDP 3 and Manufacturing Method Thereof

In the PDP 3 of the present embodiment, as is the case with the PDP 2, the recessed portion 50*a* is formed between the scan electrode 502 and the sustain electrode 503 in the front panel 50. Also, the scan electrodes 502 and the sustain electrodes 503 have a double layer system that includes (i) the electrode first element layers 502*a*, 503*a* and (ii) the electrode second element layers 502*b*, 503*b*. Therefore, in the PDP 3 of the present embodiment, as is the case with the PDP 2 above, in the sustain discharge period during the driving, the opposite discharge is generated along the path connecting the scan electrode 502 and the sustain electrode 503. As a result, it is possible to reduce the power consumption by improving the luminous efficiency while suppressing the increase of the firing voltage Vf.

Additionally, in the manufacturing method of the PDP 3 of the present embodiment, as described above, a photosensitive dielectric material in a form of a sheet is used to form the dielectric layer 504, and the exposure and development method is used to form the recessed portions 50*a*. Also, on the bottom surface 50*b* of the recessed portion 50*a*, the dielectric protective layer 505 is connected directly to the main surface of the front substrate 500. Therefore, compared to the PDPs that are made by the manufacturing method of the above-described second embodiment in which the sandblasting method is used to form the recessed portion 40*a*, the processed surfaces of the PDP3 which are made by the manufacturing method of the present embodiment do not tarnish like frosted glass, and have high optical transmittance.

In the PDP 3 of the present embodiment, as is the case with the above-described first and second embodiments, it is possible to adopt numerous variations.

FIRST EXAMPLE OF MODIFICATION

Figure 17:
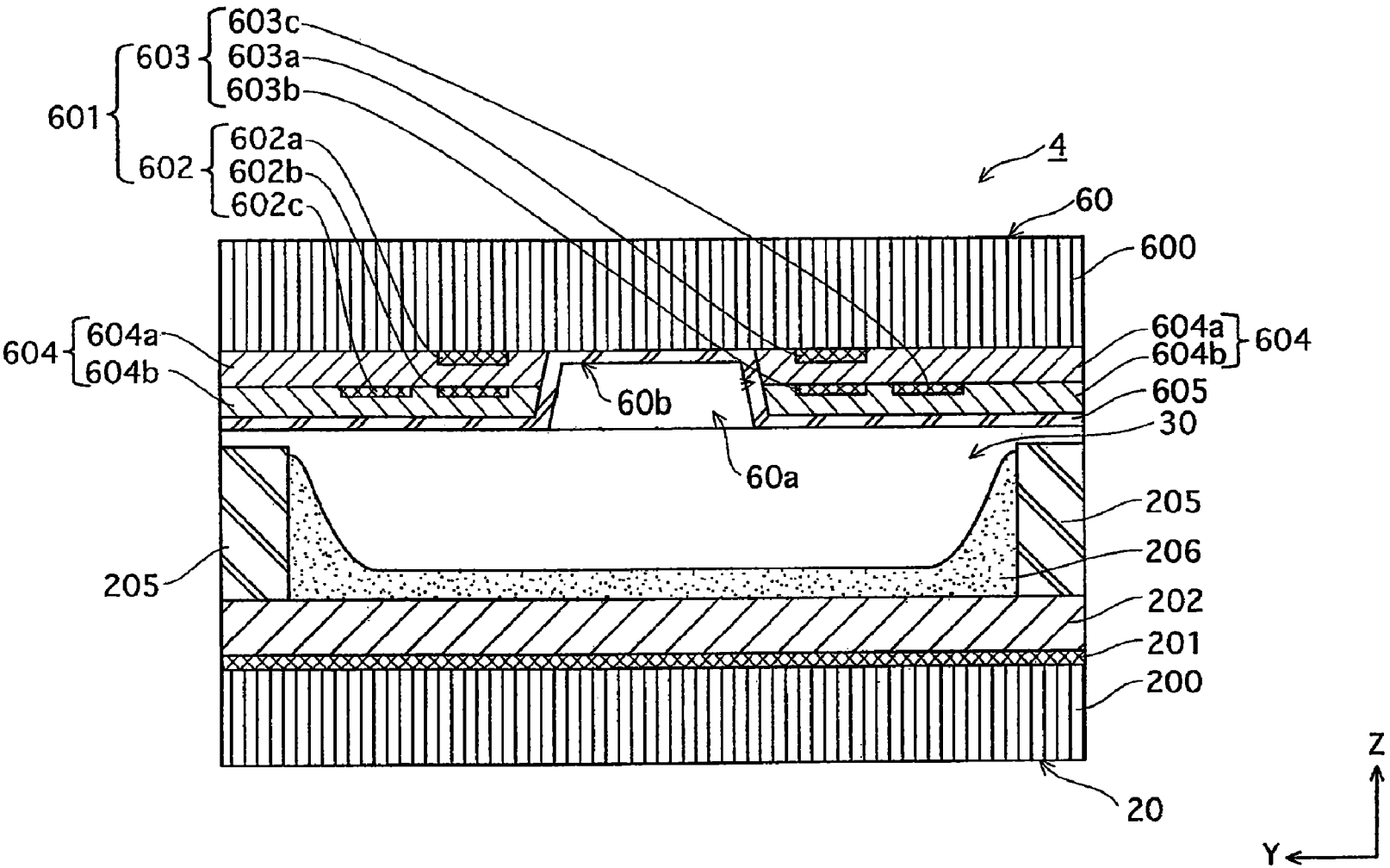
FIG. 17 shows the sectional view of the main part of the PDP 4 of the fourth embodiment.

The following are the descriptions of a structure of a PDP 4 of the first example of modification with reference to FIG. 17.

As shown in FIG. 17, on a front panel 60 in the PDP 4 of the present example of modification, each scan electrode 602 and sustain electrode 603 that is included in a display electrode pair 601, contains electrode third element layers 602*c* and 603*c* as well as electrode first element layers 602*a* and 603*a*, and second element layers 602*b* and 603*b*. An arrangement and a structure of electrode first element layers 602*a*, 603*a* and electrode second element layers 602*b*, 603*b* are the same as the PDP 3 of the above-described third embodiment. In the PDP 4 of the present example of modification, the electrode third element layers 602*c* and 603*c* are added to the above-described element layers 602*a*, 603*a*, 602*b*, 603*b* and aligned parallel to the electrode second element layers 602*b* and 603*b* (aligned at the same layer level as the second element layers in Z axial direction), in the scan electrode 602 and the sustain electrode 603.

Additionally, the descriptions of the part excluding the structures of the scan electrodes 602 and the sustain electrodes 603 are omitted here, for the descriptions including the manufacturing method of the scan electrodes 602 and the sustain electrodes 603 are the same as those of the PDP 3 in the above-described third embodiment.

The PDP 4 of the present example of modification has a slight disadvantage compared to the PDP 3 of the above-described third embodiment from the perspective of blocking visible light. However, the substantial effect is within a negligible range. Also, in the PDP4 of the present example of modification, a size of the opposite discharge that is generated during the sustain discharge period in the driving between the scan electrode 602 and the sustain electrode 603 (space in a recessed portion 60*a*) can be set larger than a size of the opposite discharge in the PDP 3 of the above-described third embodiment.

This is because the scan electrodes 602 and the sustain electrodes 603 of the PDP 4 of the present example of modification include three element layers 602*a*, 603*a*, 602*b*, 603*b*, 602*c*, 603*c* respectively. Also, in the PDP 4 of the present example of modification, it is possible to set the cross sectional areas of scan electrodes 602 and sustain electrodes 603 larger than the above-described PDP 3 to keep the electric resistance low.

It should be noted that, in the PDP 4 of the present example of modification, as is the case with the above-described first, second and third embodiments, it is possible to adopt numerous variations.

SECOND EXAMPLE OF MODIFICATION

Figure 18:
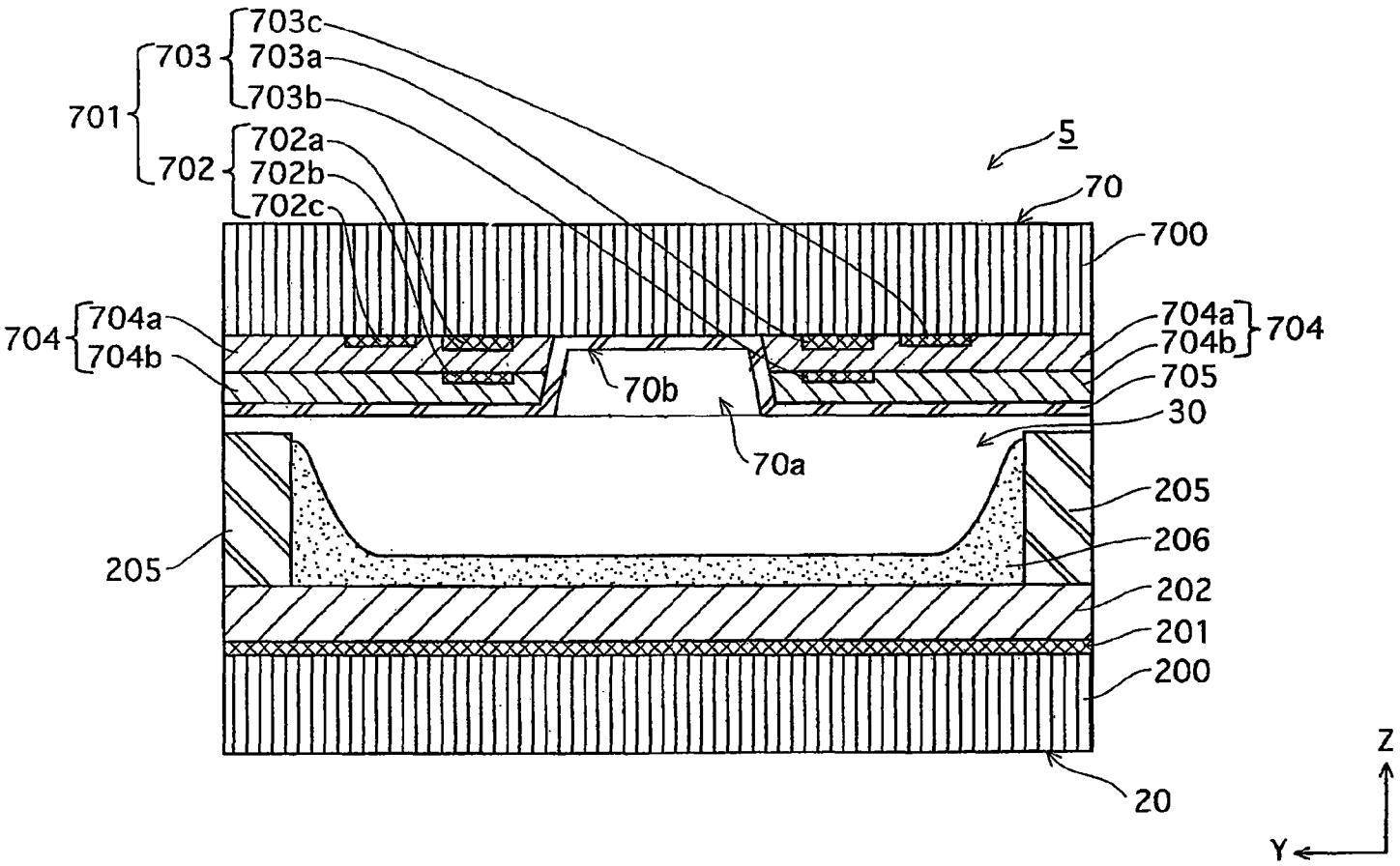
FIG. 18 shows the sectional view of the main part of the PDP 5 of the fifth embodiment.

The following is a description of a structure of a PDP 5 of the second example of modification with reference to FIG. 18.

As shown in FIG. 18, the PDP 5 of the present example of modification, as in the case with the PDP 4 of the above-described first example of the modification, has a structure in which each scan electrode 702 and sustain electrode 703 in the front panel 70 contains three element layers: electrode first element layers 702*a* and 703*a*, second element layers 702*b* and 703*b*, and electrode third element layers 702*c* and 703*c*. However, in the PDP 5 of the present example of the modification, contrary to the PDP 4 of the first example of modification that is described above, the electrode third element layers 702*c* and 703*c* that are included in the scan electrode 702 and the sustain electrode 703 respectively, are aligned parallel to each of the electrode first element layers 702*a* and 703*a* (aligned at the same layer level as the first element layers in Z axial direction).

It should be noted that, in the structure of the PDP 5 of the present example of modification, the descriptions excluding the structure of the above-described scan electrodes 702 and the sustain electrodes 703 are omitted, for the descriptions are the same as those of (i) the PDP3 of the above-described third embodiment and (ii) the PDP 4 of the above-described first example of modification.

The PDP 5 of the present example of modification has the same advantage as the PDP 4 of the above-described first example of modification. Additionally, the PDP 5 of the present example of modification includes the scan electrode third element layers 702*c* and the sustain electrode third element layer 703*c* as the components of the scan electrode 702 and the sustain electrode 703 that are aligned parallel to the electrode first element layers 702*a* and 703*a* respectively. Therefore, it is considered that the sustain discharge between the scan electrode 702 and the sustain electrode 703 in the sustain discharge period during the driving causes the opposite discharge in the space in the recessed portion 70*a*. Then, as is the case with the PDP 1 of the above-described first embodiment, the opposite discharge triggers the surface discharge between the scan electrode third element layer 702*c* and the sustain electrode third element layer 703*c* in the dielectric protective layer 705. As a result, it is considered that the PDP 5 of the present example of modification has an advantage of having a large discharge size since the discharge area in the sustain discharge period during the driving further expands to the sides of the sub barrier ribs 205.

It should be noted here that, in the PDP 5 of the present example of modification, it is also possible to adopt the same variations as described above.

(Others)

The first, second and third embodiment and the first and the second examples of modification that are described above, are the several examples that are considered to be preferable upon practice of the present invention under the present set of circumstances, and shall not be limited to such embodiments and examples of modifications that are described above. For example, constituent materials that are used for manufacturing PDP 1, 2 and 3 of the above-described first, second and third embodiments can be changed if necessary and may take other forms. For example, in the PDP 1-5 of the first, second and third embodiments and the first and second examples of modification, the barrier ribs 203 of the back panel 20 are formed in parallel crosses, with the combination of the main barrier ribs 204 and the sub barrier ribs 205. However, it is possible to adopt, for example, a striped or meandering barrier rib structure.

Additionally, as to (i) the front panel 10 of the PDP 1 of the first embodiment, and (ii) the front panel 40 of the PDP 2 of the second embodiment, the bottom surfaces 10*b* and 40*b* of the recessed portions 10*a*, 40*a* that are formed between the scan electrodes 102, 402 and the sustain electrodes 103, 403 are kept more inward in the thickness direction of the front substrate 100, 400 than each of the scan electrodes 102, 402 and the sustain electrodes 103, 403. Especially in the PDP 2 of the second embodiment, the bottom surface 40*b* of the recessed portion 40*a* is kept more inward in the thickness direction of the front substrates 400 than all of the element layers 402*a*, 403*a*, 402*b*, 403*b* that are included in the scan electrode 402 and the sustain electrode 403 (see FIG. 10).

However, in the present invention, as well as the above-described third embodiment and the PDP 3-5 of the first and second example of modification, it is acceptable so long as the bottom surfaces of the recessed portions are kept more inward in the thickness direction of the front substrate than the main surfaces of the element layers of the scan electrode and the sustain electrode facing toward the space, which are the closest to the discharge space of a plurality of element layers.

INDUSTRIAL APPLICABILITY

The present invention makes it possible to manufacture PDPs at low cost and is useful for actualizing the PDPs that can be driven with low power consumption and a high efficiency.

The invention claimed is:

1. A plasma display panel including a pair of panel members that are disposed in opposition to each other with a space therebetween, a first panel member out of the pair of panel members having a first electrode and a second electrode that are arranged parallel to each other with a predetermined interval on a surface of a first substrate facing toward the space, and a dielectric layer covering the surface of the first substrate, wherein the first panel member includes a recessed portion that is recessed in a thickness direction of the first substrate, in an area between the first electrode and the second electrode on the surface facing toward the space, each of the first electrode and the second electrode includes a plurality of element layers that are (i) arranged separately from each other in a thickness direction of the dielectric layer and (ii) electrically connected, and the bottom surface of the recessed portion is kept to be more inward in the thickness direction of the first substrate than a main surface of an element layer which is arranged closest to the space among the plurality of element layers.

2. The plasma display panel of claim 1, wherein the space is filled with a rare gas that includes xenon whose partial pressure is 3 kPa or more, the dielectric layer has a relative permittivity in a range of 4 to 12 inclusive, and one of (i) a distance between a surface of the dielectric layer facing the space and each side surface of the first electrode and the second electrode and (ii) a distance between a surface of the dielectric layer facing the recessed portion and the each side surface of the first electrode and the second electrode is in a range of 10 μm to 40 μm inclusive.

3. The plasma display panel of claim 2, wherein
a distance between the surface of the dielectric layer facing the space and a surface of the element layer, arranged closest to a second panel member among the plurality of element layers, is set to be within a range of the distance.

4. The plasma display panel of claim 3, wherein
the plurality of element layers contain a metallic material as a main component.

5. The plasma display panel of claim 3, wherein
the dielectric layer is interposed between each of the plurality of element layers.

6. The plasma display panel of claim 3, wherein
in each first electrode and second electrode, the plurality of element layers overlap each other when seen in the thickness direction of the first substrate.

7. The plasma display panel of claim 3, wherein
in each of the first electrode and the second electrode, at least one element layer out of the plurality of element layers is arranged parallel to the main surface of the first substrate.

8. The plasma display panel of claim 3, wherein
only the dielectric layer is arranged between surfaces of side walls of the recessed portion and the plurality of element layers, and
respective distances between the surface of the dielectric layer facing the recessed portion and each side surface of the plurality of element layers are substantially equivalent.

9. The plasma display panel of claim 3, wherein
the recessed portion has an opening width of at least 200 μm in a direction of a shortest line connecting the first electrode and the second electrode.

10. The plasma display panel of claim 2, wherein
a depth of the recessed portion in the first panel member is in a range of 10 μm to 30 μm inclusive.

11. The plasma display panel of claim 2, wherein
on a main surface of the dielectric layer in the recessed portion, a dielectric protective layer is formed by using at least one material selected from a material group that consists of MgO, $MgAl_2O_4$, SrO, AlN, and $La_2O_3$.

12. The plasma display panel of claim 11, wherein
the dielectric protective layer covers a whole surface of the dielectric layer facing toward the space, and
a first section of the dielectric protective layer, which is located in wall surfaces of the recessed portion, has higher crystallinity than a second section that excludes the first section.

13. The plasma display panel of claim 11, wherein
the dielectric protective layer covers the whole surface of the dielectric layer facing toward the space, and
the first section of the dielectric protective layer, which is located in the wall surfaces of the recessed portion, has a more regulated crystalline orientation than the second section that excludes the first section.

14. The plasma display panel of claim 11, wherein
the dielectric protective layer covers the whole surface of the dielectric layer facing toward the space, and
the first section of the dielectric protective layer in the wall surfaces of the recessed portion has a larger secondary electron emission coefficient than the second section that excludes the first section.

15. The plasma display panel of claim 2, wherein
the recessed portion is exposed to the space, and
discharge is generated along the path connecting the first electrode and the second electrode in the recessed portion.

16. The plasma display panel of claim 2, wherein
the first electrode and the second electrode with the recessed portion therebetween constitute each of a plurality of display electrode pairs, and
on a second substrate included in a second panel member out of the pair of panel members, barrier ribs are respectively arranged between each adjacent display electrode pairs among the plurality of display electrode pairs so as to divide the space.

17. A manufacturing method of a plasma display panel, comprising:
an electrode formation step to form a first electrode and a second electrode to align parallel to each other with a predetermined interval on one main surface of a first substrate,
a dielectric layer formation step to form a dielectric layer to cover the main surface of the first substrate, and
a recessed portion formation step, in which part of the dielectric layer between the first electrode and the second electrode is removed to form a recessed portion whose bottom surface is kept to be more inward in a thickness direction of the first substrate than main surfaces of the first electrode and the second electrode facing toward the space, wherein
the electrode formation step is executed in parallel with the dielectric layer formation step, and
the first electrode and the second electrode are formed in a manner that (i) each electrode includes a plurality of element layers which are arranged separately from each other in the thickness direction of the first substrate, (ii) the element layers are electrically connected to each other, and (iii) the dielectric layer is formed in each space between the plurality of element layers.

18. The manufacturing method of a plasma display panel of claim 17, wherein
an arrangement step in which a second substrate is arranged (i) to face in the direction of the recessed portion of the first substrate, and (ii) to have a space between the first substrate and the second substrate, and the first substrate and the second substrate are sealed together at peripheries thereof,
a gas filling step to fill the space with a rare gas that includes xenon whose partial pressure is 3 kPa or more, and
in the dielectric layer formation step, the dielectric layer is formed in such a way that a relative permittivity thereof is in a range of 4 to 12 inclusive, and one of (i) a distance between a surface of the dielectric layer facing the space and each side surface of the first electrode and the second electrode and (ii) a distance between a surface of the dielectric layer facing the recessed portion and the each side surface of the first electrode and the second electrode is in a range of 10 μm to 40 μm inclusive.

19. The manufacturing method of a plasma display panel of claim 17, wherein
in the electrode formation step, a metallic material is mainly used to form the plurality of element layers.

20. The manufacturing method of a plasma display panel of claim 17, wherein
in the recessed portion formation step, the recessed portion is formed to have an opening width of 200 μm or above in a direction of a shortest line connecting the first electrode and the second electrode.

21. The manufacturing method of a plasma display panel of claim 18, wherein
in the recessed portion formation step, a sandblasting method is used to remove part of the dielectric layer.

22. The manufacturing method of a plasma display panel of claim 18, wherein in the recessed portion formation step, part of areas of the first electrode and the second electrode in a width direction is also removed.

23. The manufacturing method of a plasma display panel of claim 20, including:

a second dielectric layer formation step in which the dielectric layer is formed on side wall surfaces of the recessed portion, covering edges of the element layers that are exposed during the recessed portion formation step.

24. The manufacturing method of a plasma display panel of claim 23, wherein in the second dielectric layer formation step, a dielectric material in a form of a sheet is used to form the dielectric layer.

25. The manufacturing method of a plasma display panel of claim 18, wherein in the dielectric layer formation step, a photosensitive dielectric sheet is used to form the dielectric layer, and in the recessed portion formation step, an exposure etching method is used to form the recessed portion.

26. The manufacturing method of a plasma display panel of claim 18, including:

a protective layer formation step in which the dielectric protective layer is formed on a surface of the dielectric layer in an area of the recessed portion, by using at least one material selected from a material group that consists of MgO, $MgAl_2O_4$, SrO, AlN, and $La_2O_3$.

* * * * *